US010926378B2

(12) United States Patent
Duescher et al.

(10) Patent No.: US 10,926,378 B2
(45) Date of Patent: Feb. 23, 2021

(54) ABRASIVE COATED DISK ISLANDS USING MAGNETIC FONT SHEET

(71) Applicants: Wayne O. Duescher, Maplewood, MN (US); Cameron M. Duescher, Lino Lakes, MN (US)

(72) Inventors: Wayne O. Duescher, Maplewood, MN (US); Cameron M. Duescher, Lino Lakes, MN (US)

( * ) Notice: Subject to any disclaimer, the term of this patent is extended or adjusted under 35 U.S.C. 154(b) by 427 days.

(21) Appl. No.: 16/028,585

(22) Filed: Jul. 6, 2018

(65) Prior Publication Data

US 2019/0009389 A1 Jan. 10, 2019

Related U.S. Application Data

(60) Provisional application No. 62/530,119, filed on Jul. 8, 2017.

(51) Int. Cl.

| | |
|---|---|
| ***B24D 11/04*** | (2006.01) |
| ***B24D 11/00*** | (2006.01) |
| ***B24D 18/00*** | (2006.01) |

(52) U.S. Cl.

CPC ..... *B24D 11/04* (2013.01); *B24D 11/001* (2013.01); *B24D 18/0072* (2013.01); *B24D 2203/00* (2013.01)

(58) Field of Classification Search

CPC .. B24D 11/04; B24D 11/001; B24D 18/0072; B24D 2203/00

(Continued)

(56) References Cited

U.S. PATENT DOCUMENTS 3,353,308 A * 11/1967 Zane ..... B24D 11/00 451/529
4,257,696 A * 3/1981 Kronman ..... B41B 13/10 283/115

(Continued)

OTHER PUBLICATIONS

Wayne O. Duescher, Three-point spindle-supported floating abrasive platen, U.S. Appl. No. 12/661,212, filed Mar. 12, 2010. Earliest Publication No. US 20110223835 A1 Earliest Publication Date: Sep. 15, 2011.

(Continued)

*Primary Examiner* — George B Nguyen
(74) *Attorney, Agent, or Firm* — Mark A. Litman & Associates, P.A.

(57) ABSTRACT

Abrasive disk sheet articles having raised islands coated with abrasive have a flexible disk polymer backing. The top flat surfaces of the raised islands are coated with a liquid controlled-thickness slurry mixture of abrasive particles and a polymeric adhesive by use of a magnetic precision-thickness coating-control font sheet having individual open holes that are slightly smaller than the respective raised islands. The magnetic coater font sheet is placed in flat-surfaced contact with the raised island surfaces where each individual font sheet open hole is aligned with a respective island surface. A magnet placed on the non-island surface of the disk polymer backing urges the magnetic coater font sheet into conformal contact with the island surfaces. A squeegee device moved along the font sheet fills and level coats the island tops with a uniform-thickness abrasive slurry mixture. After coating, the font sheet is removed and the abrasive slurry is solidified.

22 Claims, 6 Drawing Sheets

(58) Field of Classification Search
USPC ..... 451/529
See application file for complete search history.

(56) References Cited

U.S. PATENT DOCUMENTS 4,593,495 A 6/1986 Kawakami et al.
4,918,870 A 4/1990 Torbert et al.
5,205,082 A 4/1993 Shendon et al.
5,251,802 A * 10/1993 Bruxvoort ..... B24D 3/002 228/121
5,329,732 A 7/1994 Karlsrud et al.
5,335,453 A 8/1994 Baldy et al.
5,364,655 A 11/1994 Nakamura et al.
5,380,390 A * 1/1995 Tselesin ..... B23D 61/026 156/230
5,421,768 A 6/1995 Fujiwara et al.
5,423,716 A 6/1995 Strasbaugh
5,443,416 A 8/1995 Volodarsky et al.
5,449,316 A 9/1995 Strasbaugh
5,569,062 A 10/1996 Karlsrud et al.
5,597,346 A 1/1997 Hempel, Jr.
5,643,053 A 7/1997 Shendon
5,643,067 A 7/1997 Katsuoka et al.
5,683,289 A 11/1997 Hempel, Jr.
5,738,574 A 4/1998 Tolles et al.
5,769,697 A 6/1998 Nishio
5,800,254 A 9/1998 Motley et al.
5,874,318 A 2/1999 Baker et al.
5,910,041 A 6/1999 Duescher
5,916,009 A 6/1999 Izumi et al.
5,944,583 A 8/1999 Cruz et al.
5,961,169 A 10/1999 Kalenian et al.
5,964,651 A 10/1999 Hose
5,964,653 A 10/1999 Pertlov et al.
5,967,882 A 10/1999 Duescher
5,975,997 A 11/1999 Minami
5,985,093 A 11/1999 Chen
5,989,104 A 11/1999 Kim et al.
5,993,298 A 11/1999 Duescher
5,993,302 A 11/1999 Chen et al.
6,024,630 A 2/2000 Shendon et al.
6,027,398 A 2/2000 Numoto et al.
6,048,254 A 4/2000 Duescher
6,050,882 A 4/2000 Chen
6,056,632 A 5/2000 Mitchel et al.
6,074,277 A 6/2000 Arai
6,080,050 A 6/2000 Chen et al.
6,089,959 A 7/2000 Nagahashi
6,102,777 A 8/2000 Duescher et al.
6,116,993 A 9/2000 Tanaka
6,120,352 A 9/2000 Duescher
6,126,993 A 10/2000 Orcel et al.
6,132,298 A 10/2000 Zuniga et al.
6,146,259 A 11/2000 Zuniga et al.
6,149,506 A 11/2000 Duescher
6,159,073 A 12/2000 Wiswesser et al.
6,162,116 A 12/2000 Zuniga et al.
6,165,056 A 12/2000 Hayashi et al.
6,168,506 B1 1/2001 McJunken
6,179,956 B1 1/2001 Nagahara et al.
6,183,354 B1 2/2001 Zuniga et al.
6,217,433 B1 4/2001 Herrman et al.
6,224,472 B1 5/2001 Lai et al.
6,251,215 B1 6/2001 Zuniga et al.
6,270,392 B1 8/2001 Hayashi et al.
6,299,741 B1 10/2001 Sun et al.
6,361,420 B1 3/2002 Zuniga et al.
6,371,838 B1 4/2002 Holzapfel
6,390,901 B1 5/2002 Hiyama et al.
6,390,905 B1 5/2002 Korovin et al.
6,394,882 B1 5/2002 Chen
6,398,906 B1 6/2002 Kobayashi et al.
6,425,809 B1 7/2002 Ichimura et al.
6,436,828 B1 8/2002 Chen et al.
6,439,965 B1 8/2002 Ichino
6,439,978 B1 8/2002 Jones et al.
6,443,821 B1 9/2002 Kimura et al.
6,447,368 B1 9/2002 Fruitman et al.
6,491,570 B1 12/2002 Sommer et al.
6,506,105 B1 1/2003 Kajiwara et al.
6,558,232 B1 5/2003 Kajiwara et al.
6,585,567 B1 7/2003 Black et al.
6,592,434 B1 7/2003 Vanell et al.
6,592,439 B1 7/2003 Li et al.
6,607,157 B1 8/2003 Duescher
6,659,850 B2 12/2003 Korovin et al.
6,663,466 B2 12/2003 Chen et al.
6,672,949 B2 1/2004 Chopra et al.
6,729,944 B2 5/2004 Birang et al.
6,752,700 B2 6/2004 Duescher
6,769,969 B1 8/2004 Duescher
6,837,779 B2 1/2005 Smith et al.
6,893,332 B2 5/2005 Castor
6,896,584 B2 5/2005 Perlov et al.
6,899,603 B2 5/2005 Homma et al.
6,899,607 B2 5/2005 Brown
6,899,609 B2 5/2005 Hong
6,908,366 B2 6/2005 Gagliardi
6,935,013 B1 8/2005 Markevitch et al.
7,001,251 B2 2/2006 Doan et al.
7,001,257 B2 2/2006 Chen et al.
7,008,295 B2 3/2006 Wiswesser et al.
7,008,303 B2 3/2006 White et al.
7,014,535 B2 3/2006 Custer et al.
7,018,275 B2 3/2006 Zuniga et al.
7,018,906 B2 3/2006 Chen et al.
7,029,380 B2 4/2006 Horiguchi et al.
7,033,251 B2 4/2006 Elledge
7,044,838 B2 5/2006 Maloney et al.
7,081,042 B2 7/2006 Chen et al.
7,086,929 B2 8/2006 Wiswesser et al.
7,101,272 B2 9/2006 Chen et al.
7,101,273 B2 9/2006 Tseng et al.
7,125,313 B2 10/2006 Zelenski et al.
7,144,304 B2 12/2006 Moore
7,147,541 B2 12/2006 Nagayama et al.
7,166,016 B1 1/2007 Chen
7,250,368 B2 7/2007 Kida et al.
7,276,446 B2 10/2007 Robinson et al.
7,292,427 B1 11/2007 Murdoch et al.
7,357,699 B2 4/2008 Togawa et al.
7,367,867 B2 5/2008 Boller
7,393,790 B2 7/2008 Britt et al.
7,419,910 B2 9/2008 Minamihaba et al.
7,422,634 B2 9/2008 Powell et al.
7,445,847 B2 11/2008 Kulp
7,446,018 B2 11/2008 Brogan et al.
7,452,817 B2 11/2008 Yoon et al.
7,456,106 B2 11/2008 Koyata et al.
7,456,107 B2 11/2008 Keleher et al.
7,470,169 B2 12/2008 Taniguchi et al.
7,485,028 B2 2/2009 Wilkinson et al.
7,485,241 B2 2/2009 Schroeder et al.
7,488,235 B2 2/2009 Park et al.
7,488,236 B2 2/2009 Shimomura et al.
7,488,240 B2 2/2009 Saito
7,491,116 B2 2/2009 Sung
7,491,342 B2 2/2009 Kamiyama et al.
7,507,148 B2 3/2009 Kitahashi et al.
7,510,974 B2 3/2009 Li et al.
7,520,798 B2 4/2009 Muldowney et al.
7,520,800 B2 4/2009 Duescher
7,527,271 B2 5/2009 Oh et al.
7,527,722 B2 5/2009 Sharan
7,553,214 B2 6/2009 Menk et al.
7,568,970 B2 8/2009 Wang
7,572,172 B2 8/2009 Aoyama et al.
7,579,071 B2 8/2009 Huh et al.
7,582,221 B2 9/2009 Netsu et al.
7,601,050 B2 10/2009 Zuniga et al.
7,614,939 B2 11/2009 Tolles et al.
7,618,529 B2 11/2009 Ameen et al.
7,632,434 B2 12/2009 Duescher
7,648,410 B2 1/2010 Choi

(56) References Cited

U.S. PATENT DOCUMENTS

| | | | |
|---|---|---|---|
| 7,699,684 | B2 | 4/2010 | Prasad |
| 7,708,621 | B2 | 5/2010 | Saito |
| 7,731,568 | B2 | 6/2010 | Shimomura et al. |
| 7,741,656 | B2 | 6/2010 | Nakayama et al. |
| 7,753,761 | B2 | 7/2010 | Fujita |
| 7,754,611 | B2 | 7/2010 | Chen et al. |
| 7,762,870 | B2 | 7/2010 | Ono et al. |
| 7,807,252 | B2 | 10/2010 | Hendron et al. |
| 7,822,500 | B2 | 10/2010 | Kobayashi et al. |
| 7,833,907 | B2 | 11/2010 | Anderson et al. |
| 7,837,800 | B2 | 11/2010 | Fukasawa et al. |
| 7,838,482 | B2 | 11/2010 | Fukasawa et al. |
| 7,840,305 | B2 | 11/2010 | Behr et al. |
| 7,883,397 | B2 | 2/2011 | Zuniga et al. |
| 7,884,020 | B2 | 2/2011 | Hirabayashi et al. |
| 7,897,250 | B2 | 3/2011 | Iwase et al. |
| 7,922,783 | B2 | 4/2011 | Sakurai et al. |
| 7,947,190 | B2 | 5/2011 | Brown |
| 7,950,985 | B2 | 5/2011 | Zuniga et al. |
| 7,955,964 | B2 | 6/2011 | Wu et al. |
| 7,972,396 | B2 | 7/2011 | Feng et al. |
| 8,002,860 | B2 | 8/2011 | Koyama et al. |
| 8,021,215 | B2 | 9/2011 | Zuniga et al. |
| 8,025,813 | B2 | 9/2011 | Liu et al. |
| 8,029,640 | B2 | 10/2011 | Zuniga et al. |
| 8,043,140 | B2 | 10/2011 | Fujita |
| 8,047,899 | B2 | 11/2011 | Chen et al. |
| 8,062,096 | B2 | 11/2011 | Brusic et al. |
| 8,062,098 | B2 | 11/2011 | Duescher |
| 8,066,551 | B2 | 11/2011 | Chen et al. |
| 8,070,909 | B2 | 12/2011 | Shanmugasundram et al. |
| 8,071,479 | B2 | 12/2011 | Liu |
| 8,088,299 | B2 | 1/2012 | Chen et al. |
| 8,101,060 | B2 | 1/2012 | Lee |
| 8,101,093 | B2 | 1/2012 | De Rege et al. |
| 8,256,091 | B2 | 9/2012 | Duescher |
| 8,545,583 | B2 | 10/2013 | Duescher |
| 2004/0235406 | A1* | 11/2004 | Duescher ..... B24D 11/001 451/527 |
| 2005/0032469 | A1* | 2/2005 | Duescher ..... B24D 11/001 451/548 |
| 2005/0118939 | A1* | 6/2005 | Duescher ..... B24D 11/00 451/527 |
| 2008/0299875 | A1* | 12/2008 | Duescher ..... B24D 18/00 451/56 |
| 2010/0003904 | A1* | 1/2010 | Duescher ..... B24B 37/26 451/259 |
| 2011/0223835 | A1 | 9/2011 | Duescher |
| 2011/0223836 | A1 | 9/2011 | Duescher |
| 2011/0223838 | A1 | 9/2011 | Duescher |
| 2014/0120806 | A1 | 5/2014 | Duescher |
| 2014/0127976 | A1 | 5/2014 | Duescher |
| 2019/0009389 | A1* | 1/2019 | Duescher ..... B24D 11/04 |

OTHER PUBLICATIONS

Wayne O. Duescher, Three-point fixed-spindle floating-platen abrasive system, U.S. Appl. No. 12/799,841, filed May 3, 2010. Earliest Publication No. US 20110223836 A1 Earliest Publication Date: Sep. 15, 2011.

Wayne O. Duescher, Fixed-spindle and floating-platen abrasive system using spherical mounts , U.S. Appl. No. 12/807,802, filed Sep. 14, 2010. Earliest Publication No. US 20110223838 A1 Earliest Publication Date: Sep. 15, 2011.

* cited by examiner

ABRASIVE COATED DISK ISLANDS USING MAGNETIC FONT SHEET

RELATED APPLICATIONS DATA

This application claims priority from U.S. provisional Patent Application Ser. No. 62/530,119, filed 8 Jul. 2017 and titled "ABRASIVE COATED DISK ISLANDS USING MAGNETIC FONT SHEET."

BACKGROUND OF THE ART

Field of the Invention

The present invention relates to abrasive media and processes for manufacturing the abrasive media. The media are thin flexible abrasive sheeting used for grinding, lapping or polishing workpiece surfaces. In particular, the present invention relates to media having an annular distribution of abrasive particles or agglomerates bonded in monolayers to the top flat surfaces of raised island shapes that are repeated in patterned arrays capable of operating at high surface speeds. Forming flat surfaced raised islands integrally attached to backing sheets, precisely leveling the height of each island, coating the island surfaces with abrasive particles or abrasive composite agglomerate beads economically creates an abrasive article that will grind or lap a workpiece precisely flat and also generate a smooth workpiece surface. Commercially available non-island abrasive disk articles presently used for lapping can not simultaneously produce at high abrading speeds both a flat and smooth surface that is required for flat-lapping. Continuous flat coated disks that do not have an annular band of coated abrasive present relatively slow moving and slow abrading surfaces at the inner disk diameter areas that results in uneven workpiece material removal at these areas. Disks having a continuous coated surface area will produce a smooth workpiece surface but will not produce a flat surface due to hydroplaning effects when used with a water lubricant at high lapping speeds. When a workpiece hydroplanes, it tilts relative to the flat moving abrasive which causes one or multiple portions of the workpieces to be abraded more than other portions. This uneven abrading causes the workpiece to have an undesirable non-flat surface. Abrasive disks having electroplated raised islands with uneven metal-trapped abrasive particles positioned at different elevations can generate a flat workpiece surface but are not capable of producing a smooth workpiece surface. Agglomerates or beads that encapsulate very small abrasive particles which are coated on flat-surfaced island tops can produce a smooth workpiece finish and a precision-flat workpiece surface when used at very high abrading speeds of approximately 10,000 surface feet per minute.

The surface discontinuities provided by a series of independent gap-spaced raised islands break up the abrading coolant water boundary layer that builds in thickness as a function of the land length between the abrasive surface and the workpiece. Reduction of the boundary layer, which lifts the workpiece unevenly away from the abrasive surface, minimizes the occurrence of hydroplaning of the workpiece thereby producing flatter workpiece parts. The boundary layer thickness changes not only as a function of the length of a continuous abrasive segment in contact with a moving water film but also with the relative velocity between the abrasive segment and the moving water.

Presentation of the abrasive in a narrow radial-width large diameter annular band provides a more uniform abrading surface speed across the workpiece surface than does a smaller diameter continuous coated abrasive disk. To provide a uniform localized abrading speed across the radial width of a rotating annular abrasive disk, the workpiece is rotated in the same direction as the abrasive disk and at rotational speeds that are close to the abrasive disk.

In the same way that an automobile tire having a pattern of ribbed tire threads maintains more intimate contact with a wet road surface than does a smooth surfaced tire, abrasive media having a pattern of abrasive coated raised islands maintains more intimate contact with a workpiece surface than does abrasive media that has a continuous layer of abrasive coated directly on the surface of a backing sheet. Small abrasive particles must be in direct contact with a workpiece to enable material removal from the workpiece. If a portion of the workpiece is floated above the abrasive due to the separation caused by the thickness of the induced water boundary layer, no abrading contact is made with the workpiece in that area. Coolant water freely passing through flow channels formed by the valley passageways between the raised islands flushes out grinding swarf and prevents swarf debris particles from scratching the surface of a workpiece when they are lodged between the moving abrasive and the workpiece surface.

BACKGROUD OF THE INVENTION

Abrasive articles having a single or mono layer of individual abrasive particles or composite abrasive agglomerates coated on the flat surfaces of raised islands attached to a flexible backing media provides the capability to grind and polish workpieces both flat and smooth during high speed lapping and grinding operations. Performance, manufacturing and lapping process technique issues related to the primary problems of: out-of-flat grinding caused by hydroplaning of the workpiece; providing a grinding swarf debris removal path; the effective use of all the abrasive particles coated on an abrasive article and the importance of the abrasive sheet thickness variations when operated at high rotational speeds have been defined and numerous solutions are presented. To produce accurate smooth high speed lapping it is critical that the abrasive be worn evenly across the abrasive article surface to maintain presentation of a flat abrasive surface to workpiece surfaces throughout the working life of the abrasive article. It is also very important that all the abrasive attached to the surface of an abrasive article be positioned at the same elevation relative to the back side of the backing to allow contact of all of the particles when the article is mounted to a precisely flat platen that is rotated at very high speeds.

High abrading surface speeds are required to effectively utilize the cutting action of diamond abrasive that can produce very high material removal rates on very hard substrate workpiece materials. The small abrasive particles that are required to produce smooth workpiece surfaces are too small to be directly coated on backings, but rather, the small particles are joined together in agglomerates of a larger size. A technique of using screens having equal volume cell openings can be used for forming equal-sized composite spherical glass, ceramic beads and phenolic beads. The beads can be solid or hollow. The beads may be comprised of a ceramic material or the beads may be comprised of a agglomerate mixture of different materials including ceramic materials and abrasive particles. Preferably, the beads are solid abrasive agglomerates comprised of very small abrasive particles enclosed by an erodible ceramic matrix material. Variations in the thickness of abrasive disk articles and variations in the flatness of rotating platens prevent the effective use of small particles coated directly onto backing sheets.

Annular band shapes of abrasive coated on a disk backing sheet presents abrasive to a workpiece where all of the abrasive particles have a near-equal surface speed contact with a workpiece which assures even wear of both the abrasive and the workpiece. Presenting abrasive particles at the top flat surfaces of raised island structures arranged in an annular band array pattern, where the islands have narrow tangential widths, tends to break up the continuous boundary layers of lubricant water formed during high speed lapping. The shorter and thinner boundary layers help prevent hydroplaning of a workpiece. It is very difficult to prevent hydroplaning of workpieces when lapping a workpiece at high speed using small abrasive particles or abrasive agglomerates directly coated on the surface of a backing sheet.

Typical abrasive particle or agglomerate sizes are only 25 microns, or 0.001 inches, which is small compared to the depth of the coolant water that can be present on the surface of the abrasive sheet. Use of raised islands having open radial passageways allows free outward motion of the water due to centrifugal forces. Clean water can be applied continuously to provide the required cooling action that removes the frictional heat generated by the contact action of the moving abrasive. Abrasive swarf material generated by abrading action is swept away from the workpiece surface when it is carried along with the excess water that travels radially under the surface of the workpiece within the island passageways. Scratches generated by swarf particles becoming trapped between the abrasive surface and the workpiece surface are significantly reduced with the use of raised islands. Use of monolayers (single layers) of abrasive particles or abrasive composite agglomerates maximizes the use of individual abrasive particles and allows flat grinding of composite dissimilar workpiece materials including semiconductor devices having metal embedded within ceramic materials.

The manufacture of flat surfaced raised island abrasive articles that are to be used in lapping or flat-lapping is critical in that the finished article product should have abrasive particles that are all bonded to an abrasive disk article at the same elevation from the backside of the abrasive article. It is not critical to control the absolute height of abrasive flat islands as the depth of the water passage valleys located between the island structures can vary considerably and still perform the function of a simple water passageway. However, the total thickness variation of the monolayer abrasive coated abrasive article across the full annular surface of the abrasive must be controlled to within a small fraction of the size of the abrasive particles or agglomerates coated on the island surfaces.

Many different sized workpiece parts require many different sized abrasive articles. Each selected annular band size would necessitate a number of different abrasive articles with each having different particle sizes. The different abrasive particle sized articles are required to complete the typical process of using progressively smaller abrasive particles as a workpiece is ground or lapped. The disk manufacturing system described here allows commodity materials to be used to make a wide variety of sizes of uncoated annular band raised island disks. Only the flat surfaced raised island surfaces that are contained in the annular band portion of the disk are precisely flattened by machining or grinding as the flatness of the low-level inner radius is not important for abrading action.

The raised island shapes are preferred to not extend to the outer radial edge of the abrasive article backing sheet as some distance is required between the island edges and the backing sheet border edge. By having an outboard island-free annular gap area, each island has a smooth continuous-form shape that can be abrasive particle coated with good structural integrity of the bond between the abrasive particles and the island flat surface. Island structures located at the outer edge of an abrasive disk are not cut to form circular shapes of the disk. Cutting these integral island shapes weakens them structurally and causes them to be separated from the disk when subjected to typical abrading forces. Separated island structures can cause severe damage to valuable workpieces.

Lapping, polishing and grinding can be performed on the surface of a workpiece part by placing the workpiece in moving contact with a raised island abrasive sheet and controlling the contact force holding the workpiece against the abrasive. An increased contact force results in higher workpiece material removal rates and a more coarse or rough workpiece surface finish. A reduced force results in a smoother finish but lower material removal rates. Water, which is often used both as a coolant and also as an agent to flush grinding swarf from the contact area between the workpiece and the abrasive can cause hydroplaning of the workpiece when there is a high relative surface speed between the workpiece and the abrasive article surface.

A continuous film of water present at the moving contact interface surface area between the workpiece and the abrasive surface tends to separate the workpiece surface from the abrasive surface. Hydroplaning of the workpiece occurring during the abrading action tends to develop cone or saddle shapes on the workpiece surface thereby preventing the formation of a precision flat workpiece surface. Use of raised abrasive top-coated flat surfaced islands attached to a backing sheet allows passage of water within the passageways formed by the valleys between islands while the abrasive is maintained in direct contact with a workpiece surface. Each abrading island contact raised land area is flat across its surface and can be used for flat lapping or flat grinding of workpiece articles. Circular shaped island land areas are preferred to be formed with short land-width distances in the direction of travel of the abrasive article relative to the workpiece surface to minimize hydroplaning effects.

A wide range of diamond or other abrasive particles or agglomerates or spherical beads are attached to the surface of abrasive articles. Primary materials utilized as abrasive particles are faceted crystals having sharp edges on many sides. The sharp particle edges provide cutting surfaces that are brought in pressure contact with a workpiece to cut, grind or polish the workpiece surface.

When abrasive particles are used, the scratched depth or material removed as a layer from a workpiece substrate is thought to be roughly proportional to the diameter or size of the particle. Large diameter particles are used to aggressively remove large quantities of workpiece material but they leave large scratches on the surface of the workpiece that result in a coarse or rough surface finish. Progressively smaller sized abrasive particles are used to effect a smooth surface as the scratches produced are also progressively smaller and the top "surface damage" produced by the previous larger sized particle is removed by the subsequent small particles. When the size of the particles are less than 20 microns or 10 microns and particularly, when less than 1 micron, the small quantity of abrasive particles contained in a monolayer coated on a backing prevents extended use of the abrasive article as this thin layer of abrasive particles quickly becomes dull or the particles are worn away and expelled from the article surface rendering the abrading performance of the article ineffective.

It has been found in the abrasive industry that the small sized particles desired to produce a smooth workpiece surface finish can be joined together in composite agglomerates with an eroding matrix to both provide long abrading life of the article and to produce a smooth surface finish. The eroding mixture is controlled to erode away at a rate where the individual particles become loosened and are expelled from the agglomerate at the time that the particles become dull from abrading, thereby providing a fresh new layer of sharp particles in contact with the workpiece surface. The eroding process continues progressively from the top of the agglomerate to the bottom of the agglomerate until all of the volume of the agglomerate is worn away and all of the individual particles are used. Composite agglomerates such as beads have a typical size of 45 microns or less for a mixture of 3 micron sized abrasive particles. The 45 micron agglomerates are often spherical shaped ceramic beads where the 45 micron size is not too large that enough wear occurs on one portion of the abrasive article that the flatness of the abrasive article is unacceptable due to the agglomerate abrasive height change that occurs when only some of the agglomerates are worn down and other agglomerates have little wear.

A present difficulty for the accomplishment of high speed lapping and polishing is the lack of availability of high quality abrasive article sheets, disks, or long strips that have certain important characteristics. It is necessary that abrasive articles have an annular band of island structures abrasive coated surfaces that are extremely flat and of uniform thickness. Conventional flat surface grinding or lapping platens are set up to use the full surface area of a circular (no-annular) shaped flat flexible sheet of abrasive. However, the abrasive contact surface speed of these rotating disks varies from a maximum speed at the outer radius to zero at the innermost center at the disk, where the radius is zero. The grinding material removal rate is roughly proportional to the surface speed of the moving abrasive, so that most of the grinding or lapping action, and the most efficient grinding or lapping action occurs at the outer portion of a rotating disk.

Not only is the inside portion of the non-annular abrasive disk not used to remove workpiece surface material, but also this portion of the abrasive is not worn down by the workpiece, resulting in a shallow, cone shape of the abrasive disk surface. This uneven abrasive surface wear continues with usage of the disk, with the cone angle progressively increasing to a sharper angle. This cone angle is translated to the surface of the workpiece as the uneven surface of the abrasive article creates an uneven surface contour to the workpiece surface. An effective answer to this uneven wear is to create an abrasive disk with a narrow annular band of abrasive material located at the outer edges of the disk. This annular abrasive disk configuration allows the abrasive to wear down more evenly across the full surface of the abrasive disk as a workpiece is in continuous abrading contact with the full abrasive annular surface.

Lapping film is an abrasive article having a thin, flexible polymer backing coated with abrasive particles or coated with spherical bead abrasive agglomerates. Abrasive lapping sheets, commonly referred to as lapping films, typically have very precision thickness abrasive sheet article thicknesses and also have monolayer thickness abrasive particle coatings. These lapping film features are critical to produce the very precise flat surfaces and the very smooth polished surfaces required for optical workpieces and fiber optic devices. Lapping films are continuous-coated disks or rectangle sheets and do not have annular bands of abrasive on disks. They have been in common use for many years from multiple suppliers. Typically they have mono-layers of beads that encapsulate select sizes of micron-sized diamond abrasive particles. Lapping film is produced by continuous abrasive bead coating of thin and flexible web backing materials that are converted into disks or sheets after coating.

Using the same configuration of raised island abrasive disks having different abrasive particle sizes is very important because at least three different sized particles (large, medium and small) are used to progressively lap or polish a workpiece. The large particles (30 micron) flatten the workpiece, the medium particles (10 micron) provide the first stage of smoothing the workpiece and the small particles (3 micron or even sub-micron) provide a highly polished surface. The island abrasive disks are quickly changed with the use of vacuum attachment to precision-flat (0.5 microns) platens in sequence for the same abrading-contact workpiece to perform the lapping or polishing procedure.

Each individual annular abrasive disk article must be independently produced with appropriate product characteristics and accuracies. The resin and the abrasive particles must both be distributed uniformly across the full surface of the sheet of abrasive coated backing that is used for lamination to the top surfaces of the individual islands that are contained in the abrasive disk annular band. Adhesives are used to structurally bond the segments of the abrasive coated backing article to the individual island flat top surfaces. Also, the quantity of both resin and abrasive particles applied to an abrasive article must be accurately controlled to assure the item-to-item abrading performance consistency of the finished abrasive article product.

Producing the individual abrasive island coated annular disks using a batch production process is very efficient, has low capital equipment costs and produces disk very quickly to answer market demands with low inventory costs. The polymer island disk substrates are inexpensive and can be ground flat where each annular band of islands has the same precision thickness as measured from the back mounting side of the disk substrate backing.

The raised islands have heights ranging from 0.020 inches (0.5 mm) to 0.125 inches (3.18 mm). The raised islands have diameters that range from 0.125 inches (3.18 mm) to 0.75 inches (19 mm). The gap distances between adjacent island structures range in size from 0.010 inches (0.5 mm) to 0.125 inches (3.18 mm). The mono-layer of abrasive beads adhesive-coated on the abrasive lapping films are erodible where the micron sized abrasive particles are encapsulated in a porous ceramic matrix that progressively wears down during the abrading action. This eroding action releases new sharp abrasive particles as the old dull particles are expelled from the eroded bead structures.

Spherical bead composite agglomerate abrasive particle shapes are a preferred agglomerate shape for creating a single layer or monolayer of composite agglomerates on a backing sheet. The spherical shape provides more consistency in shape and consistency in slurry coating or abrasive particle drop coating than do acicular shaped or irregular shaped agglomerates formed by crushing a hardened abrasive composite material. The geometry difference between an agglomerate sphere shape and an agglomerate block shape has a pronounced effect on the utilization of individual abrasive particles coated on an abrasive article.

The primary bulk of individual abrasive particles contained in a spherical erodible abrasive composite agglomerate are located at the sphere center of the spherical agglomerate which is positioned a sphere radius distance above the surface of a backing sheet. When the agglomerate abrasive spheres are raised to a elevated position above the backing surface, the elevated position of the bulk of the sphere-contained individual abrasive particles assures that most of the particles contained in a spherical agglomerate are effectively used in abrading action as the abrasive article becomes worn down.

An abrading example is flat lapping or polishing where a flat workpiece surface is presented in surface contact with a flat abrasive article to produce cutting, grinding or polishing action where the contact surface pressure, in pounds per square inch or Newtons per square cm, is uniform across a portion of, or the full surface of the workpiece. Contact pressures are typically controlled to be low at the onset of the polishing process, increased progressively and then decreased in the final phase of a lapping operation to obtain the most effective utilization of the abrasive media. A single or mono layer of abrasive particles or agglomerates is highly desired for flat lapping of workpieces including pump seals, bearing seals, optical components including but not limited to a lens, a fiber optic connector, optical crystals, and semiconductor substrates.

In high speed lapping, the moving abrasive sheet typically has very high surface speeds to take advantage of the high cut rates that occur when using diamond abrasive at high surface speeds.

This invention references commonly assigned U.S. Pat. Nos. 6,752,700; 7,632,434; 8,062,098; 8,256,091; and 8,545,583 and all contents of which are incorporated herein by reference.

U.S. Pat. No. 794,495 (Gorton) discloses dots of abrasive on round disks formed by depositing abrasive particles on adhesive binder wetted dot areas printed on the backing, primarily to aid the free passage of grinding debris away from the workpiece surface. These dot areas are not elevated as raised island shapes from the surface of the backing.

U.S. Pat. No. 1,657,784 (Bergstrom) discloses a variety of abrasive particle primitive shaped areas with space gaps between the abrasive areas to provide a passageway for grinding swarf.

U.S. Pat. No. 3,246,430 (Hurst), U.S. Pat. No. 2,838,890 (McIntyre) and U.S. Pat. No. 2,907,146 (Dyar) disclose the effect of an uneven abrasive surface on a workpiece article and various techniques to create separated areas of abrasives.

U.S. Pat. No. 3,916,584 (Howard, et al.), herein incorporated by reference, discloses the encapsulation of 0.5 micron up to 25 micron diamond particle grains and other abrasive material particles in spherical erodible metal oxide composite agglomerates ranging in size from 10 to 200 microns and more. The large agglomerates do not become embedded in an abrasive article carrier backing film substrate surface as do small abrasive grain particles. In all cases, the composite bead is at least twice the size of the abrasive particles. Abrasive composite beads normally contain about 6 to 65% by volume of abrasive grains, and compositions having more than 65% abrasive particles are considered to generally have insufficient matrix material to form a strong acceptable abrasive composite granule.

Abrasive composite granules containing less than 6% abrasive grains lack enough abrasive grain particles for good abrasiveness. Abrasive composite bead granules containing about 15 to 50% by volume of abrasive grain particles are preferred since they provide a good combination of abrading efficiency with reasonable cost. In the invention, hard abrasive particle grains are distributed uniformly throughout a matrix of softer microporous metal oxide (e.g., silica, alumina, titania, zirconia, zirconia-silica, magnesia, alumina-silica, alumina and boria, or boria) or mixtures thereof including alumina-boria-silica or others. Silica and boria are considered as metal oxides.

The spherical composite abrasive beads are produced by mixing abrasive particles into an aqueous colloidal sol or solution of a metal oxide (or oxide precursor) and water and the resultant slurry is added to an agitated dehydrating liquid including partially water-miscible alcohols or 2-ethyl-1-hexanol or other alcohols or mixtures thereof or heated mineral oil, heated silicone oil or heated peanut oil. The slurry forms beadlike masses in the agitated drying liquid. Water is removed from the dispersed slurry and surface tension draws the slurry into spheroidal composites to form green composite abrasive granules. Other shapes than spheroidal such as ellipsoid or irregularly shaped rounded granules can be produced that also provide satisfactory abrasive granules. The green granules will vary in size; a faster stirring of the drying liquid giving smaller granules and vice versa. The resulting gelled green abrasive composite granule is in a "green" or unfired gel form.

The dehydrated green composite generally comprises a metal oxide or metal oxide precursor, volatile solvent, e.g., water, alcohol, or other fugitives and about 40 to 80 weight percent equivalent solids, including both matrix and abrasive, and the solidified composites are dry in the sense that they do not stick to one another and will retain their shape. The green granules are thereafter filtered out, dried and fired at high temperatures. The firing temperatures are sufficiently high, at 600 degrees C. or less, to remove the balance of water, organic material or other fugitives from the green composites, and to calcine the composite agglomerates to form a strong, continuous, porous oxide matrix (that is, the matrix material is sintered).

The resulting abrasive composite or granule has a essentially carbon-free continuous microporous matrix that partially surrounds, or otherwise retains or supports the abrasive grains. The firing temperatures are insufficiently high to cause vitrification or fusion. Vitrification of the composite agglomerate or granule is avoided as the external surface of the composite would change into a continuous glassy state, thereby preventing the composite from having a porous external surface. Having a porous surface on abrasive agglomerates allows liquid adhesive binders to penetrate the porous agglomerate surface somewhat or to better wet the agglomerate surface that tends to provide increased bonding strength when the agglomerate is attached to the surface of a backing sheet. The spherical composite matrix outer surface retains a degree of micro-porosity, as can be detected by the disappearance of the matrix when the spherical composite is filled with oil having the same refractive index as the matrix where the oil penetrates into the porous matrix. When the oil filled composite agglomerate is viewed with an optical microscope, only the diamond grains are visible and the dispersion of the diamond particles within the agglomerate can be seen. This oil-absorbing feature of the matrix spherical composite permits the incorporation of liquids including lubricants, liquid grinding aids, etc., to enhance performance of the composite in actual abrading operations.

The sintering temperature of the whole spherical composite bead body is limited as certain abrasive granules including diamonds and cubic boron nitride are temperature unstable and their crystalline structure tends to convert to non-abrasive hexagonal form at temperature above 1200 degree C. to 1600 degrees C., destroying their utility. An air, oxygen or other oxidizing atmosphere may be used at temperatures up to 600 degrees C. but an inert gas atmosphere may be used for firing at temperatures higher than 600 degrees C. These abrasive composite agglomerate beads incorporate abrasive particles 25 microns and less sized particles, as abrasive particle grains 25 microns and larger can be coated on abrasive articles to form useful materials.

Example 1 described a mixture of 0.5 gram of 15-micron diamond powder, 3.3. grams of 30 percent colloidal silica dispersion in water (Ludox LS) and 3 grams of distilled water that was stirred and sonically agitated to maintain a suspension. The formed agglomerates were fired, a backing sheet was coated with resin, and the abrasive agglomerates were drop coated onto the wet resin and then a resin size coat was applied to the coated agglomerates. Example 8 resulted in composite granules that ranged in diameter from 10 to 100 microns, with an average of about 50 microns and the diamond particle content was approximately 33% of the abrasive composite agglomerates. In example 6 a slurry of the average sized 50 micron abrasive agglomerates was mixed in a phenolic resin and was knife coated with a 3 mil (0.003 inch or 72 micron) knife gap setting which exceeded the size of the agglomerates.

As the individual abrasive particles were smaller than the depth of the coated resin binder slurry, there is indication that enough resin binder solvent was evaporated after coating to expose a substantial portion of the individual coated abrasive agglomerates when the abrasive product was dried. When a composite bead granule was submerged in oil having a refractive index of about 1.5 under a microscope at 70-140× the oils penetration into the porous matrix was observed by visual disappearance of the silica matrix and only diamond particle grains throughout the composite bead granule were readily visible. The dispersion of the diamond particle grains throughout the bead granule was noted.

U.S. Pat. No. 4,112,631 (Howard), herein incorporated by reference, discloses the encapsulation of 0.5 micron up to 25 micron diamond particle grains and other abrasive material particles in spherical composite agglomerates ranging in size from 10 to 200 microns. Encapsulated 75 micron composite spheres are knife-coated using a knife opening of 3 mils (76 micron) on a polyester film backing with a urethane phenoxy resin thinned with methyl ethyl keytone. The coating knife gap opening disclosed is approximately equal to the size of the composite spheres.

U.S. Pat. No. 4,256,467 (Gorsuch) and U.S. Pat. No. 5,318,604 (Gorsuch. et al.) discloses abrasive articles where the coating of fibrous cloth at island areas built up in raised height by electroplating areas of the cloth positioned in contact with electrically insulated metal having arrays of exposed circular electrically conducting island forming areas. Abrasive particles contained in the electroplating bath are introduced to fall on the upper portion of the plated metal islands during the process of attaching them to the fiber islands.

However, the particles do not lie in a common plane at a flat surface of the raised islands. Instead, the particles are attached at many different elevations within the island areas. This out of flatness occurs because the individual fibers of the cloth which support the build-up of plated metal to create raised island structures is not flat at the upper surface of the progressively built-up plated island due to the fibers being woven together to form the cloth material. The different height locations of the particles prevent the generation of precision smooth surfaces during the abrading action but the abrasive island articles are effective in producing flat work pieces.

Another disadvantage of this product is that the plated cloth material must be stripped from the electrically conductive metal base and attached as a laminate with adhesive to a backing substrate to form an abrasive article. This laminated abrasive article structure does not have the precise thickness control due to thickness variations in both the island plated cloth material and the laminating adhesive film for effective utilization of the diamond abrasive particles for high speed lapping.

Gorsuch describes where metal plated islands are formed within the individual strands of fibers of a woven fiber cloth that is stretched over an electrically conductive plate having non-island insulated areas. Diamond abrasive particles are deposited within the depth of the metal plating material that forms the pattern of islands contained within and supported by the woven cloth structure. Only those diamond particles that are exposed from the plated metal can be utilized for abrading because the hard metal is not erodible where abrasive particles buried within the metal are not available for abrading contact with a workpiece.

Also, the cloth is weak and flexible and can not resist abrading forces without severely distorting the cloth and its integral islands into a non-flat abrading surface. To provide a more durable abrasive article, the weak cloth, having the integral abrasive islands, is laminated to a structurally stiff backing sheet or disk. Because of the inherent structural weakness of this laminated abrasive cloth-based product, individual plated islands are often ripped off the laminated cloth during high speed lapping or polishing. These separated island structures often scratch or damage workpieces. This structural defect prevents these laminated abrasive articles from being used for high speed lapping or polishing of the typically valuable workpieces such as sapphire wafers or semiconductor wafers.

U.S. Pat. No. 4,311,489 (Kressner) discloses the use of irregular surface agglomerates of abrasive particles and a binder where the agglomerate binder is weaker than the agglomerate make coat binder to permit gradual wearing down of the agglomerate.

U.S. Pat. No. 4,930,266 (Calhoun, et al.) discloses the application of spherical abrasive composite agglomerates made up of fine abrasive particles in a binder in controlled dot patterns where preferably one abrasive agglomerate is deposited per target dot by use of a commercially available printing plate. Small dots of silicone rubber are created by exposing light through a half-tone screen to a photosensitive silicone rubber material coated on an aluminum sheet and the unexposed rubber is brushed off leaving small islands of silicone rubber on the aluminum. The printing plate is moved through a mechanical vibrated fluidized bed of abrasive agglomerates which are attracted to and weakly bound to the silicone rubber islands only.

The plate is brought into nip-roll pressure contact with a web backing which is uniformly coated by a binder resin which was softened into a tacky state by heat thereby transferring each abrasive agglomerate particle to the web backing. Additional heat is applied to melt the binder adhesive forming a meniscus around each particle, which increases the bond strength between the particle and the backing. The resulting abrasive has dots of abrasive particles on the backing but they are only raised away from the backing surface by the diameter of the abrasive agglomerates. Each abrasive agglomerate typically ranges in size from 25 to 100 micrometers and contains 4 micrometer abrasive particles.

U.S. Pat. No. 5,190,568 (Tselesin) discloses a variety of sinusoidal and other shaped peak and valley shaped carriers that are surface coated with diamond particles to provide a passageway for the removal of grinding debris. The problems inherent with this technique include the change in localized grinding pressure, in Newtons per square centimeter, when a work piece first contacts only a few abrasive particles located at the top of the peaks as compared to a greatly reduced pressure when the peaks are worn down and substantially more abrasive particle surface area is in contact with the workpiece.

The inherent bonding weakness of abrasive particles attached to the sloping sidewalls is discussed and the intention for some of the lower abrasive particles located away from the peaks being used to structurally support the naturally weakly bonded upper particles. The material used to form the peaks is weaker or more erodible than the abrasive particles, which allows the erodible peaks to wear down, expose, and bring the work piece into contact with new abrasive particles. Uneven wear-down of the abrasive article will reduce its capability to produce precise flat surfaces on the work piece.

Abrasive articles with these patterns of shallow sinusoidal shaped rounded island-like foundation ridge shapes where the ridges are formed of filler materials, with abrasive particles coated conformably to both the ridge peaks and valleys alike is described. However, the shallow ridge valleys are not necessarily oriented to provide radial direction water conduits for flushing grinding debris away from the work piece surface on a circular disk article even prior to wear down of the ridges. Also, a substantial portion of the abrasive particles residing on the ridge valley floors remain unused as it is not practical to wear away the full height of the rounded ridges to contact these lower elevation particles.

U.S. Pat. No. 5,219,462 (Bruxvoort, et al.) discloses the use of dot patterned recesses or through-holes in a backing sheet which are filled with a slurry of fine abrasive particles having an expanding agent which expands the slurry to rise above each recessed hole. The passageways between the raised abrasive composite dots can pass water and slurry until the dots arc worn down. A disadvantage with this type of abrasive article is that all of the abrasive particles contained in the recess hole at a location below the exposed surface of the backing sheet is lost for abrading use. The importance of the control of height of the top of the dot is recognized in the disclosure in that a flat mold surface can be pressed against the non-hardened abrasive dots but no description is presented concerning the importance and accuracy of controlling the dot heights.

U.S. Pat. No. 5,232,470 (Wiand) discloses raised molded protrusions of circular shapes composed of abrasive particles mixed in a thermoplastic binder attached to a circular sheet of backing.

U.S. Pat. No. 5,496,386 (Broberg, et al.) discloses the coating of a mixture of diluent particles and shaped abrasive particles on a make coat of resin where the function of the diluent particles is to provide structural support for the shaped abrasive particles.

U.S. Pat. No. 5,549,961 (Haas, et al.) discloses abrasive particle composite agglomerates in the shape of pyramids, truncated pyramids, and beads which are mixed in a slurry having ultrasonic energy used to lower the slurry viscosity and vacuum to minimize air bubbles. Abrasive composites are forced with abrasive article surface densities of 700 to 7,500 mold cavities per square centimeter. A typical truncated pyramid has a height of 3.15 mils (80 micrometer), a base of 7.0 mils (178 micrometer) and a top of 2 mils (51 micrometer) and is continuously abutted with adjacent pyramids to form a flat continuous sheet of abrasive. When a "daisy" form shape is cut out from a sheet, the daisy is flooded with water or water with additives including water soluble oils, emulsified oils, wetting agents which suggest low speed operation. Clay additives were used to improve the control of erodibility of the abrasive composite. Surface coatings including halide salts, metal oxides and silica were applied to the abrasive particles to increase adhesion.

U.S. Pat. No. 5,611,825 (Engen) describes resin adhesive binder systems which can be used for bonding abrasive particles to web backing material, particularly urea-aldehyde binders. There is no reference made to forming or abrasive coating abrasive islands. He describes the use of make, size and super size coatings, different backing materials, the use of methyl ethyl keytone and other solvents. Loose abrasive particles are either adhered to uncured make coat binders which have been coated on a backing or abrasive particles are dispersed in a 70 percent solids resin binder and this abrasive composite is bonded to the backing. Backing materials include very flat and smooth polyester film for common use in fine grade abrasives which allow all the particles to be in one plane. Primer coatings are used on the smooth backing films to increase adhesion U.S. Pat. No. 5,820,450 (Calhoun) and U.S. Pat. No. 5,437,754 (Calhoun) discloses the use of individual spaced truncated cones and rectangular agglomerate blocks attached to 50 micrometer (0.00196 inch) thick polyethylene terephthalate (PET) with an 18 micrometer (0.0007 inch) thick ethylene acrylic acid copolymer (EAA) surface primer coating using toluene to solvent viscosity-thin a abrasive slurry binder where the agglomerates are spaced with gaps on the backing by use of a embossed carrier web having spaced receptacles filled with the abrasive slurry mixture. U.S. Pat. No. 6,228,133 (Thurber, et al.) describes the application of silane coupling agent to abrasive particles which increases the adhesion of the particle to the binder and priming the backing surface for increased adhesion of the binder by corona discharge, ultraviolet light exposure, electron beam exposure, flame discharge and scuffing; abrasive particles are applied by electrostatic coating.

U.S. Pat. No. 5,910,471 (Christianson, et al.) discloses that the valleys between the raised adjacent abrasive composite truncated pyramids provide a means to allow fluid medium to flow freely between the abrasive composites contributes to better cut rates and increased flatness of the abraded workpiece surface.

U.S. Pat. No. 6,080,215 (Stubbs, et al.) and U.S. Pat. No. 6,277,160 (Stubbs, et al.) discloses side-by-side coatings of different size abrasive particles by use of abrasive coating slurries where the abrasive particles are surface coated with materials including coupling agents, halide salts, metal oxides including silica, refractory metal nitrides and carbides. Fillers including amorphous silica and silica clay are used in abrasive slurries which contain methyl ethyl keytone, MEK, and toluene, TOL in various mixture ratios. Drying patterns which can be seen visually and are referred to as Bernard cells alter the nature of the abrasive coating and their existence depends on airflow and heating conditions during thermal cure of the slurry binder. Polishing liquids used include lubricants, oils, emulsified organic compounds, cutting fluids and soaps.

U.S. Pat. No. 6,186,866 (Gagliardi) discloses the use of protrusions having a variety of peak-and-valley shapes comprised of an erodible grinding aid where the protrusion shapes are surface coated with an adhesive resin and abrasive particles are drop coated or electrostatically coated onto the resin forming a layer of abrasive particles conformably coated over both the peaks and valleys. There are apparent disadvantages of this product. Only a very few abrasive particles reside on the upper most portions of the protrusion shaped peaks and this small fraction of the total number of particles coated on the surface will quickly be worn down or knocked off the peaks by abrading action due to their inherently weak resin support at the curved peak apex.

As the abrading action continues with the wearing down of the erodible protrusions, more abrasive particles are available for abrading contact with a workpiece article but the advantage of the valleys used to channel coolant fluids and swarf has now diminished. The abrasive particles are very weakly attached to the sloping sidewalls of the protrusions due to the simple geometric vulnerability of bonding a separate particle to a protrusion wall side. Adhesive binder that does not naturally flow and surround the particle to generate substantial strength to resist abrading contact forces which will tend to leverage the particle and break it away from the wall. Much of the valuable superabrasive particles located in the valley areas are not utilized with this technique of particle surface conformal coating of peaks and valleys.

U.S. Pat. No. 6,217,413 (Christianson) discloses use of phenolic or other resins where abrasive agglomerates are drop coated preferably into a monolayer of abrasive agglomerates and leveling and truing which levels or evens out the abrading surface is performed on the abrasive article resulting in tighter tolerance during abrading.

U.S. Pat. No. 6,231,629 (Christianson, et al.) discloses a slurry of abrasive particles mixed in a binder to form truncated pyramids and rounded dome shapes on a backing. Fluids including water, an organic lubricant, a detergent, a coolant or combinations thereof results in a finer finish on glass. Fluid flow in valleys between the pyramid tops tends to produce a better cut rate and increased flatness during glass polishing. Abrasive diamond particles either have a blocky shape or a needle like shape and may contain a surface coating of nickel, aluminum, copper, silica or an organic coating.

U.S. Pat. No. 6,645,624 (Adefris, et al.) discloses the manufacturing of abrasive agglomerates by use of a high-speed rotational spray dryer to dry a sol of abrasive particles, oxides and water.

U.S. Pat. No. 9,393,673 (Eilers, et al.) discloses an abrasive article having patterns of shallow islands formed by depositing small island-structure areas of a polymer make coat where abrasive particles are deposited on the make coat island-structures. A polymer size coat is applied over the abrasive particles and make coat islands to structurally reinforce the abrasive particles to resist abrading forces. The individual abrasive coated islands do not have flat surfaces and the height of each island is not controlled to be uniform. The recessed areas between adjacent islands is not sufficiently deep to carry away excess coolant water used in high speed lapping or polishing. without flooding the island tops and causing hydroplaning of workpieces.

Abrasive products using small abrasive particles encapsulated in composite erodible spherical agglomerates or abrasive beads have been sold for a number of years. The 3M Superabrasives and Microfinishing Systems, 3M Abrasive Systems Division Product Guide (copyright) 3M 1994 60-4400-4692-2 (104.3) JR describes diamond particle spherical ceramic bead shaped agglomerates coated on flexible backing. The 3M Imperial™ Diamond Lapping Film, Type B is described as "diamond particles are contained in ceramic beads which makes this product more aggressive than the standard product. Grade for grade a Type B product will yield more cut, longer life, and a coarser finish. Recommended for extremely hard materials and larger parts."

Use of large diameter equal-sized abrasive particle filled porous ceramic or phenol formaldehyde adhesive resin beads as a substitute for the conventional too-small 0.002 inch (45 micron) variable-sized diameter beads offers many advantages. First, because all of the individual beads have the same equal size, all of the expensive diamond abrasive particles contained in the spherical beads is fully utilized. Second, each of the larger 0.010 (250 micron) beads can contain abrasive particles that have much larger abrasive particle sizes because these larger particles can be successfully encapsulated in the larger beads. These beads can easily encapsulate 50 or 75 micron particles compared to the limitation of 30 micron particles in the 0.002 inch (45 micron) diameter beads. Larger abrasive particles provide higher material removal rates. Third, the abrading life of the abrasive disk article is vastly improved as 0.005 inch (125 micron) diameter spherical beads contain over 10 times the abrasive as 0.002 inch (45 micron) diameter beads.

SUMMARY OF THE INVENTION

Disk Island Font Abrasive Coating

Lapping or grinding with abrasives fixed to the flat surfaces of raised island structures attached to a flexible sheet is performed at high surface speeds of at least 5,000, at least 7,500 and preferably about or at least 10,000 or more surface feet per minute (1,517; 2,228; and 3,048 meters per minute, respectively), desirably with the use of water-like lubricants to cool the workpiece and to carry away grinding swarf. A workpiece can be held rigidly or flexibly by many different types of supports, including, by way of non-limiting examples, a rotating spindle platen to effect grinding contact with a rotating abrasive platen. Hydroplaning of the workpiece on water lubricated abrasive is minimized when using abrasive covered flat surfaced raised island sheets. Hydroplaning tends to be severe for uniformly coated abrasive non-raised island disks that have historically been used for smooth polishing or lapping operations. Cone shaped workpiece surfaces are caused by hydroplaning, even when flat-coated abrasive sheets are mounted on rotary platens having raised annular bands, to concentrate all of the abrading action within a narrow radial width annular band. The abrasive platen must be ground very flat and the abrasive disk sheet must be precise in thickness to be used effectively at high speeds.

Abrasive disks of large 18 inch (0.457 m), 24 inch (0.609 m), 36 inch (0.914), 48 inch (1.22 m), 60 inch (1.5 m) or even 72 inch (1.8 m) diameters, having an outer annular band of raised islands which have a thin precise coating of diamond particles, can be produced inexpensively with very precise thickness control. Also, abrasive disks having small diameters of less than 0.75 inches (19.1 mm) may also have an outer band of raised islands. Very large disks can be used at slower rotational speeds and very small disks are operated at high speeds to generate the same linear speed where grinding is desired to be performed, and in both cases, a relatively high surface speed is reached. It is preferred that the inner radius of the raised annular band is greater than 20% and more preferred that the inner radius is greater than 30% of the outer annular band radius.

Circular, elliptical, diamond-shaped, pie-shaped or rectangular island shapes can be arranged in annular array bands on flexible disk backing substrates. Circular island shapes are preferred as they carry coolant water deep into the interior of the flat abraded surface of the workpieces and spread it outward to provide uniform cooling of the workpieces that are friction-heating caused by abrading contact of the abrasive moving relative to the workpiece. Excess coolant water is forced into the recessed channels that exist between adjacent raised abrasive islands. Because the excess water is nominally routed into the recessed channels, hydroplaning of the workpieces is avoided. This excess water also carries abrading debris along the recessed channels in a nominally radial direction where centrifugal forces caused by the rotating abrasive disk platen propels the excess water and debris off the outer circumference of the abrasive disk and platen.

Raised island foundation bases can be deposited on a backing to produce island disk substrates by a variety of means on a variety of commonly available thin flexible plastic, polymer or metal backing materials. Also, the islands can be molded as an integral part of the island substrate backing. The top surfaces of the individual islands are mutually machined or ground flat into a common plane after attachment (or molding) to the backing to establish a precisely controlled thickness relative to the bottom surface of the disk backing material. It is not critical that the absolute sheet thickness, relative to the bottom surface of the disk backing, is precisely controlled. Rather, it is only important that the heights of the top surfaces of all the islands have the same elevation from the disk backing disk mounting surface after they are deposited on the backing.

It is very important that the flexible abrasive disks having annular bands patterns of abrasive coated island structures have precisely uniform abrasive disk thicknesses across the full annular band of islands. This disk thickness is measured from the top exposed surface surfaces of the individual islands to the respective bottom mounting surface areas of the flexible disks backing at the localized portion of the measured islands. Providing precision-thickness abrasive disks allows them to be used interchangeably on precision-flat rotatable platens that operate at very high abrading speeds of greater than 10,000 sfpm. Here, the top flat surfaces of the raised islands are coated with a liquid controlled-thickness slurry mixture of abrasive particles and a polymeric adhesive by use of a magnetic precision-thickness coating-control font sheet.

A precision-thickness magnetic abrasive-coater font sheet having a pattern of individual open holes, that are slightly smaller than the respective raised islands, is used to provide a uniform-thickness liquid abrasive slurry to each individual island top surface. The magnetic coater font sheet is placed in flat-surfaced contact with the raised island surfaces where each individual font sheet open hole is aligned with a respective island surface. A permanent magnet or electromagnet that is placed on the non-island surface of the disk polymer backing urges the magnetic coater font sheet into conformal contact with the island surfaces. A squeegee device moved along the font sheet fills and level coats the island tops with a uniform-thickness abrasive slurry mixture. After coating, the font sheet is removed and the abrasive slurry is solidified to provide uniform thickness layers of abrasive particles for the individual islands on each disk. In another embodiment, the top surfaces of the disk islands can be mutually ground flat after solidification of the abrasive binder resin.

The abrasive-slurry mixture coatings on the islands can contain mono-layers of spherical beads that are filled with selected sizes of abrasive particles, including diamond, CBN, and aluminum oxide particles or other abrasive material particles. Also, the abrasive slurry mixtures can contain single abrasive particles or agglomerates of abrasive particles including diamond, CBN, and aluminum oxide particles or other abrasive material particles. A liquid adhesive is used in the abrasive slurry mixture to structurally bond the individual abrasive particles to the island top surfaces when the adhesive is solidified. The adhesive can be selected from a wide range of adhesives including phenol formaldehydes, epoxies and other adhesives. The adhesives can also contain solvents including water, alcohols, MEK, toluene and other solvents where some or all of the solvents evaporate from the abrasive slurry mixture during abrasive disk drying operations. High temperature curing profiles well known in the abrasive industry are also used to provide hard and strong support of the abrasive particles to resist abrading forces, especially for phenol formaldehyde adhesive resins.

Diamond abrasive particles are often used to lap or polish hard workpiece materials including sapphire. Coarse diamond particles are used to initially flatten a workpiece, medium sized particles are used to develop a smooth surface and very small particles are used to create ultra-smooth surfaces. Conventional abrasive beads typically have diameters of about 50 microns and can encapsulate up to 30 micron diamond particles. Beads can also encapsulate very small diamond particles having 3 micron or even sub-micron sizes for very smooth surfaces. The abrasive beads can be constructed from erodible porous ceramics or the can be produced using phenol formaldehyde adhesive resins using screens. Large, equal-sized beads can be manufactured using screens having equal-volume openings where these large beads can contain abrasive particles much larger than 30 micron diamond particles.

Coating the island top surfaces with a measured premixed slurry of adhesive binder and abrasive particles has many distinct advantages over the conventional technique of coating island top surfaces with a liquid binder and free-depositing individual abrasive particles on or into the liquid binder adhesive island coating. By mixing controlled fixed quantities of binder resin adhesives with controlled fixed quantities of abrasive particles, the ratio of adhesive to particles can be controlled exactly whereby each abrasive disk produced by this batch technique is exactly the same over long time periods with typical occasional production operations. Each manufactured disk will contain the same quantity of often expensive abrasive particles such as diamond and CBN and will provide the same abrading performance. Also, due to a uniformly mixed abrasive slurry being used, where the abrasive particles are evenly distributed within the slurry, the controlled-quantity of island-coated abrasive particles are therefore distributed uniformly across the surface of each individual island top surface. By comparison, depositing loose abrasive particles randomly on the top surfaces of island tops results in non-uniform abrasive coatings and non-uniform abrading characteristics of the disks.

DETAILED DESCRIPTION OF THE INVENTION

Figure 1:
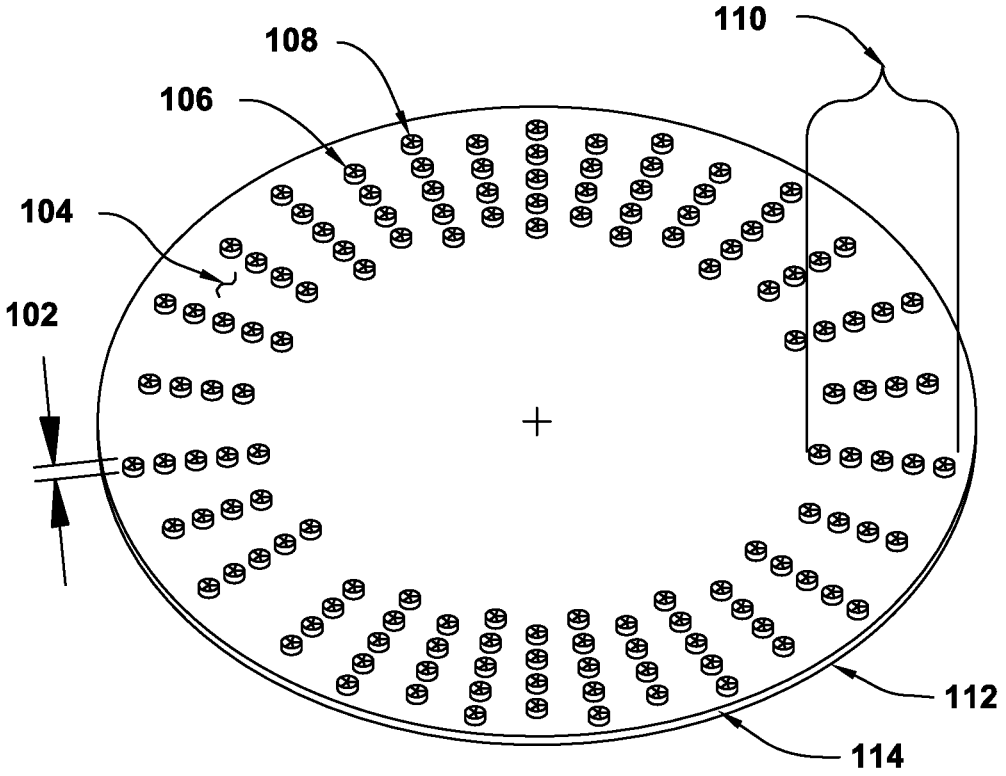
FIG. 1 is an isometric view of an abrasive disk with an annual band of raised islands.

FIG. 1 is an isometric view of an abrasive disk with an annual band of raised islands. A flexible abrasive disk 112 has attached raised island structures 106 that are top-coated with abrasive particles 108 where the island structures 106 are attached to a disk 112 transparent or non-transparent backing 114. The raised-island disk 112 has annular bands of abrasive-coated 108 raised islands 106 where the annular bands have a radial width of 110. Each island 106 has a typical width 102. The islands 106 can be circular as shown here or can have a variety of shapes comprising radial bars, ellipses, diamond shapes, rectangular shapes, hexagons, smooth-corner hexagons and other shapes (all not shown) where the abrasive-coated 108 raised islands 106 allow the abrasive disks 112 to be used successfully at very high abrading speeds in the presence of coolant water without hydroplaning of the workpieces (not shown). There are channel gap openings 104 that exist on the abrasive disk 112 between the raised island structures 106.

For high speed flat lapping or polishing, the abrasive disk 112 has an overall thickness variation, as measured from the top of the abrasive-coated 108 raised islands 106 to the bottom surface of the abrasive disk backing 114, that is typically less than 0.0001 inches 0.254 micron). This abrasive disk 112 precision surface flatness is necessary to provide an abrasive coating that is uniformly flat across the full annular band abrading surface of the abrasive disk 112 which allows the abrasive disk 112 to be used at very high abrading speeds of 10,000 surface feet (3,048 m) per minute or more. These high abrading speeds are desirable as the workpiece material removal rate is directly proportional to the abrading speeds. These abrasive disks are particularly useful for high speed polishing of sapphire wafers and other sapphire components used in cellular phones and sapphire crystals used in watches and sapphire monitor screens used in electronic display devices. In addition these disks provide very substantial production time and cost savings, often well in excess of 10 times reductions, as compared with conventional liquid abrasive slurry lapping and polishing of sapphire devices.

Figure 2:
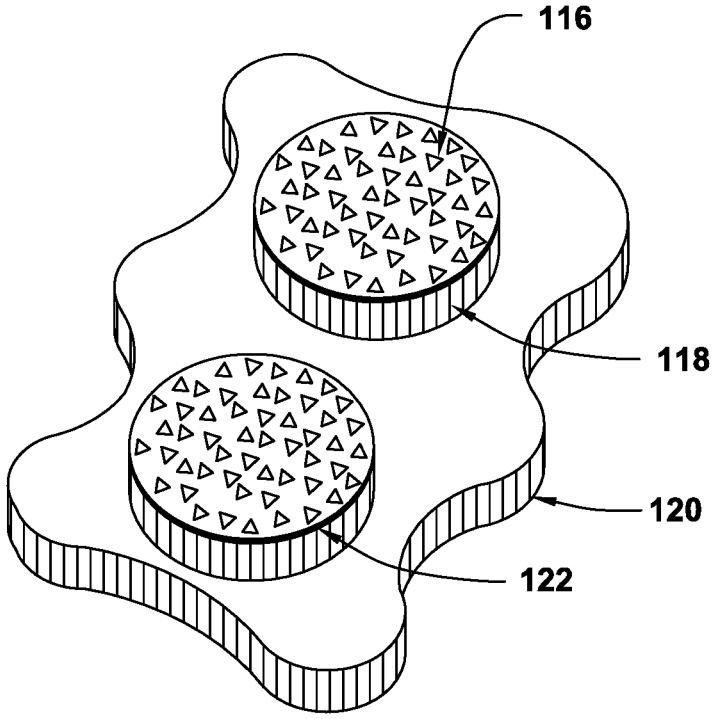
FIG. 2 is an isometric view of a portion of an abrasive disk with individual raised islands.

FIG. 2 is an isometric view of a portion of an abrasive disk with individual raised islands. A transparent or non-transparent backing sheet 120 has raised island structures 118 that are top-coated with a solidified abrasive-slurry layer mixture 122 which is filled with abrasive particles 116. The fixed-abrasive coating 122 on the raised islands 118 includes individual abrasive particles 116 or ceramic spherical beads (not shown) that are filled with very small diamond, cubic boron nitride (CBN) or aluminum oxide abrasive particles. The sizes of the abrasive particles 116 contained in the beads ranges from 60 microns to submicron sizes where the smaller sizes are typically used to polish semiconductor wafers.

Figure 3:
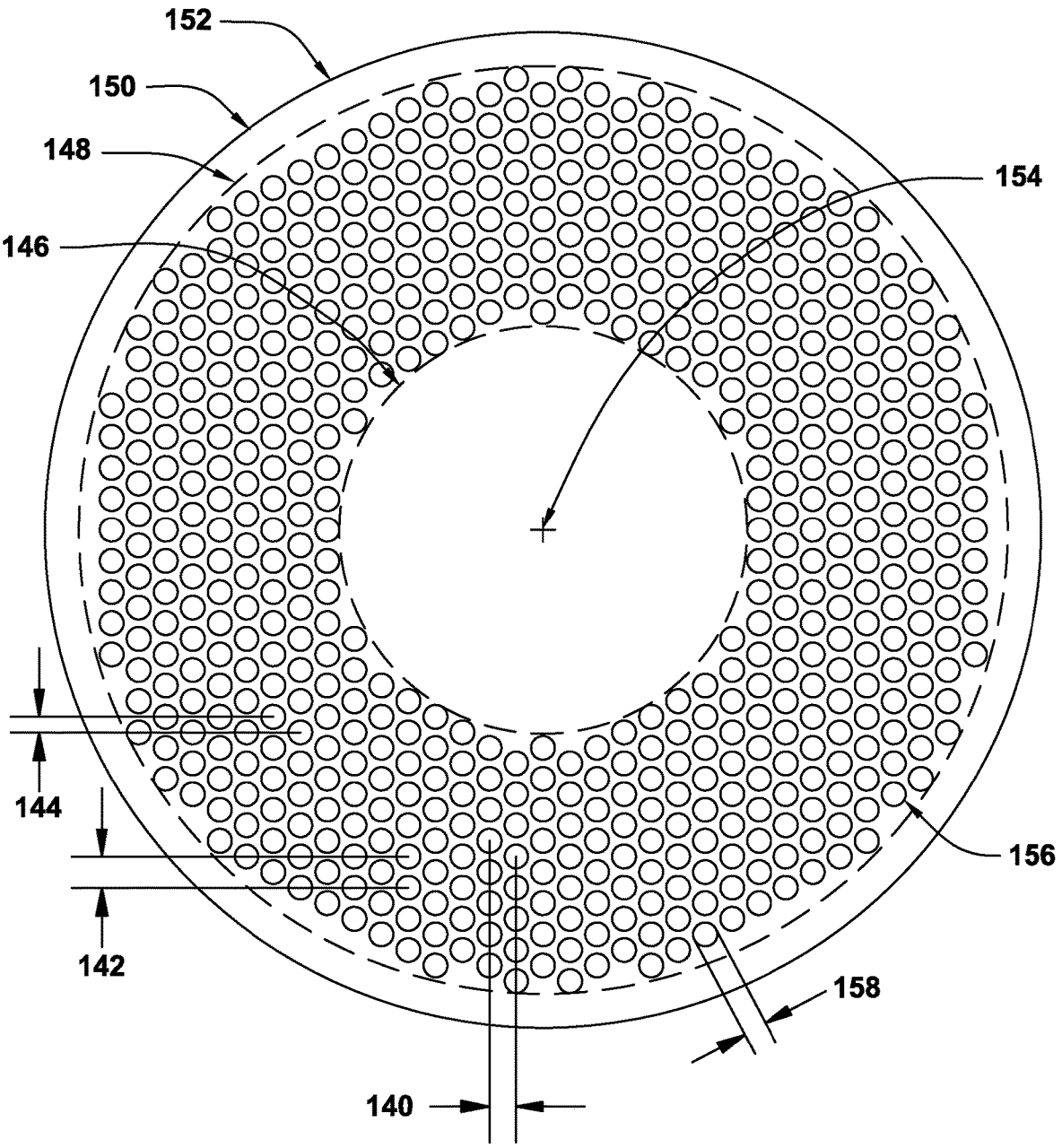
FIG. 3 is an top view of an abrasive disk with an annular band of abrasive coated islands.

FIG. 3 is an top view of an abrasive disk with an annular band of individual abrasive coated raised islands. The abrasive disk 150 has an outer diameter 152 and an annular band of abrasive coated raised islands 156 where the annular band has an approximate outer diameter 148 and an approximate inner diameter 146. The abrasive disk 150 has a rotation center 154. The individual islands 156 have island diameters 158. The array of islands 156 shown here is constructed as an rectangular array with a nominal distance 140 between the vertical columns of islands 156 and a distance 142 between repeating horizontal rows of islands 156 and the distance 144 between offset horizontal rows of islands 156.

To provide uniform wear-down of the abrasive coated raised islands 156 the annular band approximate outer diameter 148 is typically 3 times the approximate inner diameter 146 and can range from 1.5 to 6 times the approximate inner diameter 146. The workpieces (not shown) are somewhat larger than the annular width of the abrasive band and overhang both the inner 146 and outer band 148 diameters to provide uniform wear-down of the annular band of raised islands 156 as both the workpiece and the abrasive disk are rotated in the same direction. The pattern of abrasive coated raised islands 156 are shown positioned with a rectangular grid spacing but they can be positioned with a wide range of non-rectangular grid patterns (not shown).

Figure 4:
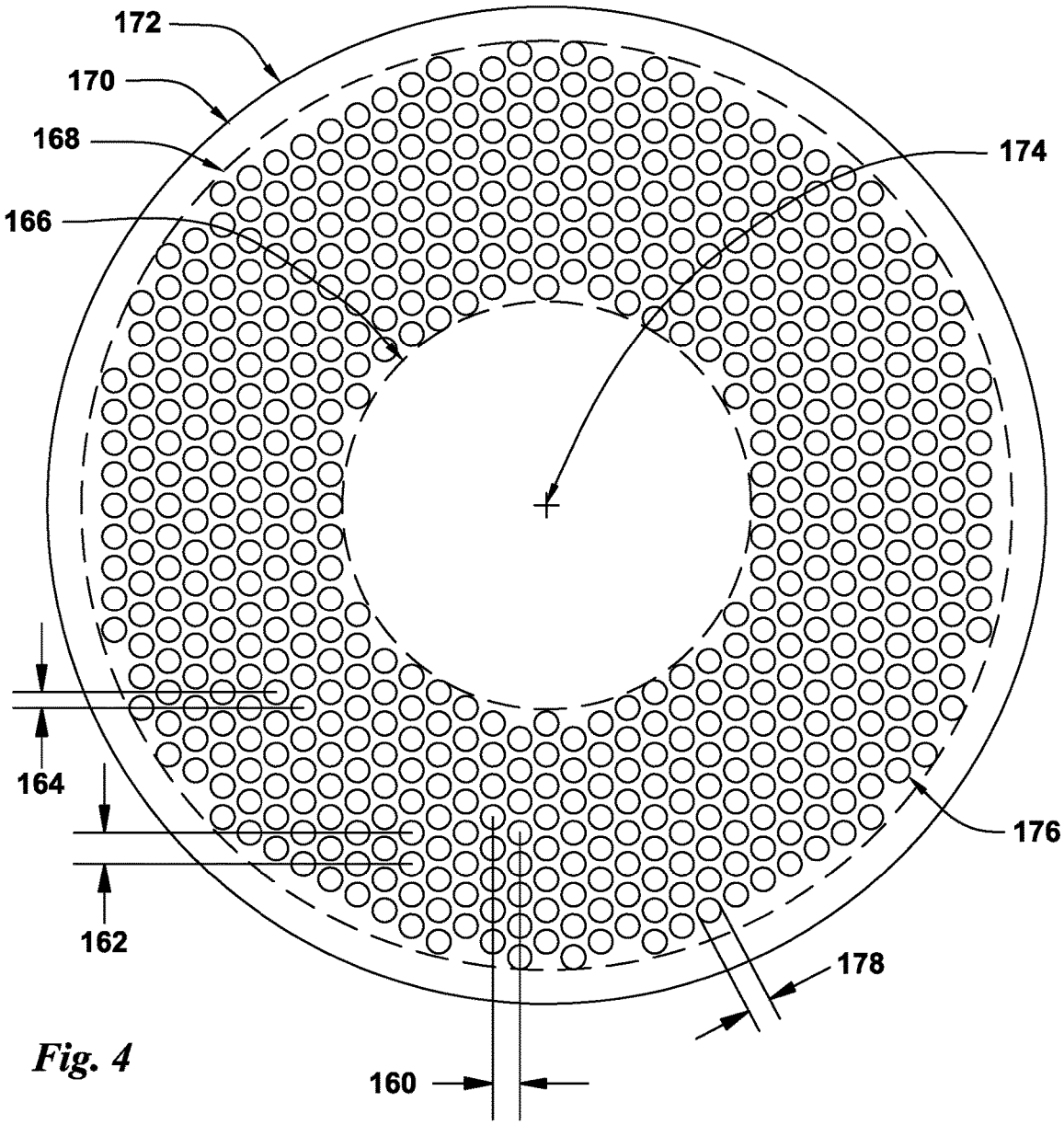
FIG. 4 is a top view of a magnetic material abrasive slurry coating font sheet.

FIG. 4 is an top view of a magnetic material abrasive slurry coating font sheet having a open hole pattern that matches the annular band of individual abrasive coated raised islands shown in FIG. 3. Each of the coating font sheet holes has a corresponding respective raised island flat surfaced structure where the individual hole patterns in the font sheet are slightly smaller than the individual respective top flat surface of the raised island structures. Because of the slightly smaller sizes of the font sheet holes than the island surfaces, the magnetic font sheet is supported by the top surfaces of the raised island structures when the font sheet is positioned in flat surfaced contact with the raised island structures and magnetic forces are imposed on the font sheet by a magnet (not shown).

The coating font sheet 170 has an outer diameter 172 and an annular band of coating font sheet holes 176 where the annular band has an approximate outer diameter 168 and an approximate inner diameter 166. The coating font sheet 170 has a rotation center 174. The individual holes 176 have hole diameters 178. The array of holes 176 shown here is constructed as an rectangular array with a nominal distance 160 between the vertical columns of holes 176 and a distance 162 between repeating horizontal rows of holes 176 and the distance 164 between offset horizontal rows of holes 176.

The pattern of coating font sheet holes 176 are shown positioned with a rectangular grid spacing but they can be positioned with a wide range of non-rectangular grid patterns (not shown). The font sheet holes 176 and the island structures (not shown) have the same relative dimensional coordinates which allows the font sheet holes 176 to be positioned in near-congruent alignment to the respective island structures when the font sheet 170 is positioned in flat surfaced contact with the island top surfaces where the font sheet holes 176 are slightly smaller than the respective island structures flat top surfaces. The coating font sheet holes 176 shapes are shown as circular but they can have many shapes including elliptical, rhombus, pie and rectangular shapes or shape combinations (not shown) and the individual raised island structure shapes can be nominally equal in size or the shapes can be nominally unequal in size.

Figure 5:
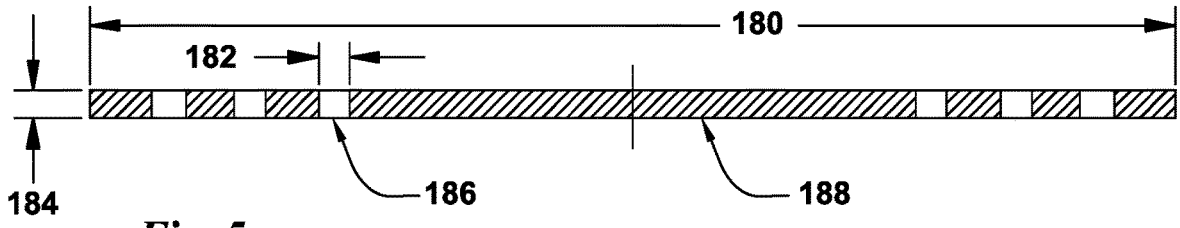
FIG. 5 is a side view of a magnetic material abrasive slurry coating font sheet and islands.

FIG. 5 is a side view of a magnetic material abrasive slurry coating font sheet having a open hole pattern that that matches the annular band of individual abrasive coated raised islands on an abrasive disk. The coating font sheet 188 has a outer diameter 180 and a uniform thickness 184 with a pattern of holes that extend through the thickness 184 of the font sheet 188. Each hole 186 has a hole shape and hole size where a circular hole 186 can have a hole diameter 182.

Figure 6:
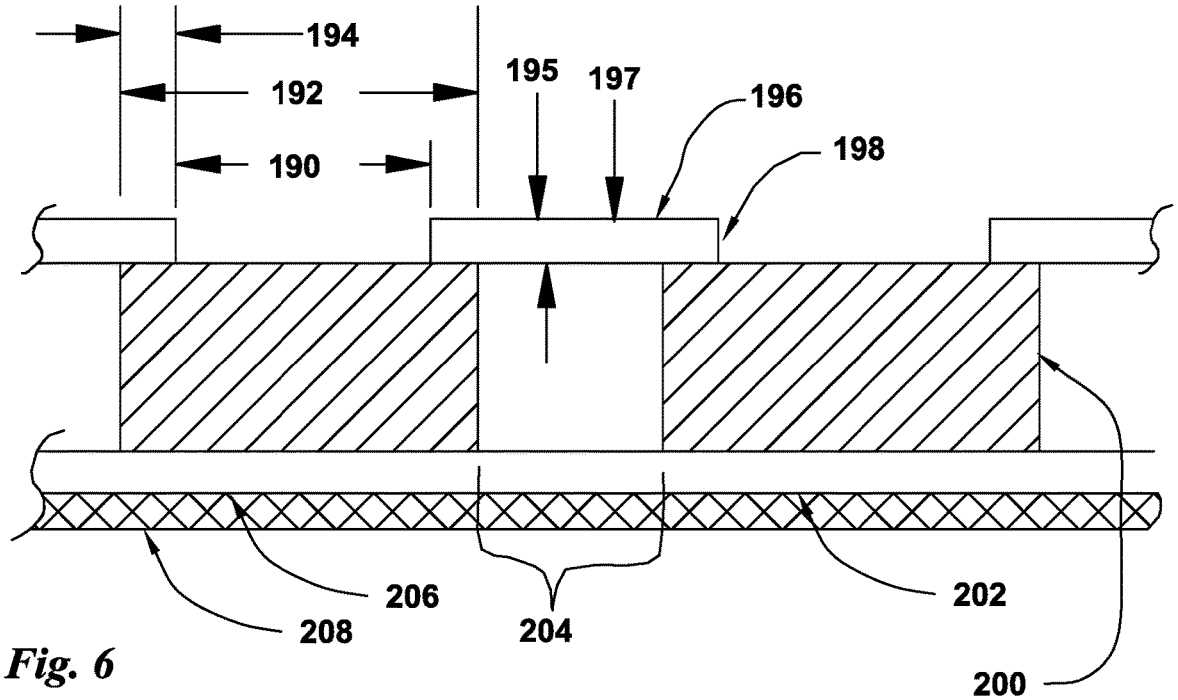
FIG. 6 is a side view of a portion of a coating hole font sheet in contact with islands.

FIG. 6 is a side view of a portion of a coating hole font sheet in conformal contact with an abrasive disk with individual raised islands structures. The flexible magnetic coating hole front sheet 196 is positioned in conformal contact with the top flat surfaces of raised island structures 200 that are attached or an integral part of a flexible non-magnetic backing 202 that is a component of an raised island disk substrate 206. A permanent or electro magnet 208 is shown positioned in contact with the bottom surface of the raised island disk substrate 206 but it can also be positioned some distance below the bottom surface of the raised island disk substrate 206. The magnet 208 applies magnet forces 197 that act on the magnetic coating hole front sheet 196 to force the coating hole front sheet 196 tightly against the flat surfaced island structures 200 to effect a liquid seal between the font sheet 196 and the island structures 200 around the periphery of each independent flat surfaced island structure 200.

There is a recessed gap area 204 between each island structure and the structural magnetic steel font sheet bridges across the raised island recessed gap areas 204. The font sheet 196 holes have openings 198 that have dimensions 190 that are smaller than the top flat surfaces of the flat surfaced island structures 200 that have dimensions 192. The font sheet 196 overlaps the individual flat surfaced island structures 200 by a distance 194 around the periphery of each flat surfaced island structure 200 which provides structural support of the font sheet 196. The overlap also provides a liquid seal to prevent leakage of a liquid abrasive and adhesive slurry (not shown) that is introduced into the font sheet 196 holes openings 198. The uniform thickness font sheet 196 has a thickness 195 that establishes the thickness of the abrasive slurry that is coated on the island structure 200 flat surfaces. The flexible non-magnetic backing 202 material can a polymer, aluminum, brass or non-magnetic stainless steel, cloth and woven fiber material or combinations of them.

Figure 7:
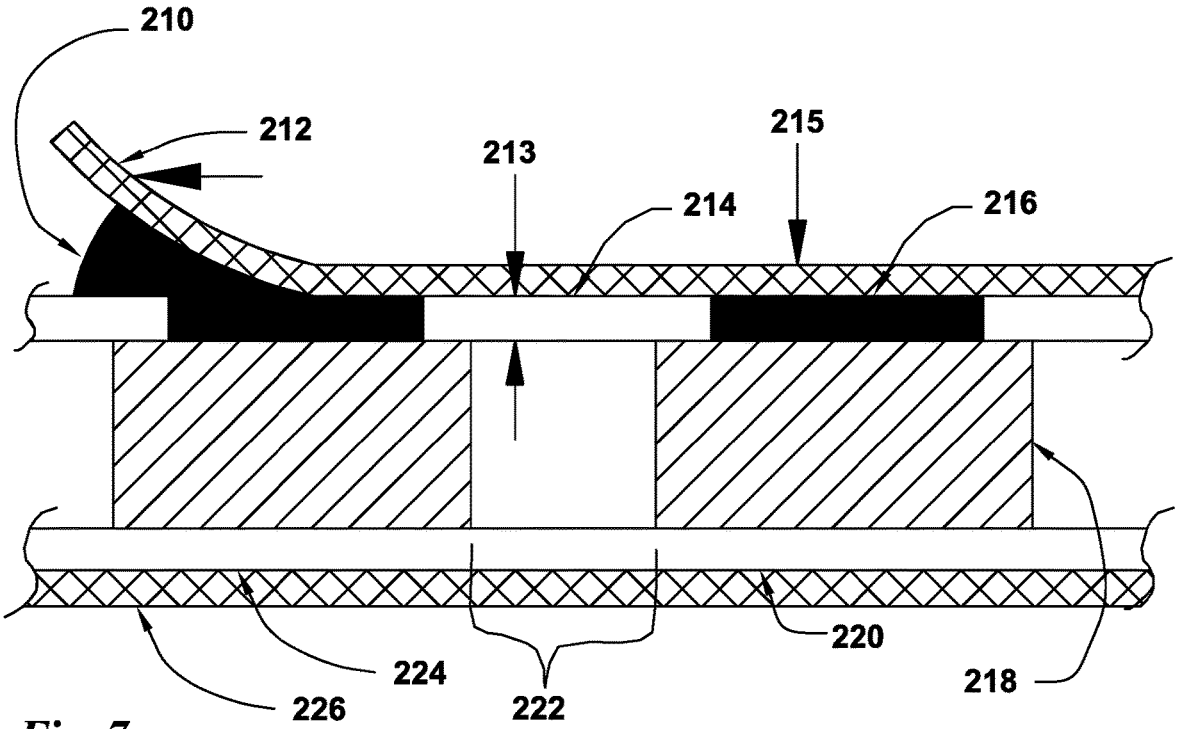
FIG. 7 is a side view of an abrasive slurry filled portion of a coating hole font sheet.

FIG. 7 is a side view of a abrasive slurry filled portion of a coating hole font sheet in conformal contact with an abrasive disk with individual raised islands structures. The flexible magnetic coating hole front sheet 214 is positioned in conformal contact with the top flat surfaces of raised island structures 218 that are attached or an integral part of a flexible non-magnetic backing 220 that is a component of an raised island disk substrate 224. A permanent or electro magnet 226 is shown positioned in contact with the bottom surface of the raised island disk substrate 224 but it can also be positioned some distance below the bottom surface of the raised island disk substrate 224. The magnet 226 applies magnet forces 215 that act on the magnetic coating hole front sheet 214 to force the coating hole front sheet 214 tightly against the flat surfaced island structures 218 to effect a liquid seal between the font sheet 214 and the island structures 218 around the periphery of each independent flat surfaced island structure 218.

There is a recessed gap area 222 between each island structure and the structural magnetic steel font sheet bridges across the raised island recessed gap areas 222. The font sheet 214 holes have openings that have dimensions that are smaller than the top flat surfaces of the flat surfaced island structures 218. The font sheet 214 overlaps the individual flat surfaced island structures 218 around the periphery of each flat surfaced island structure 218 which provides structural support of the font sheet 214. The overlap also provides a liquid seal to prevent leakage of a liquid abrasive and adhesive slurry 210, 216 that is introduced into the font sheet 214 holes openings.

A bank of excess liquid abrasive slurry 210 is acted upon by a squeegee or flexible doctor blade 212 that is moved across the surface of the uniform thickness font sheet 214 having a thickness 213 that establishes the uniform thickness 213 of the abrasive slurry 216 that is level-coated at each independent island structure 218 flat surface. After the abrasive slurry 216 is deposited at each font sheet 214 hole opening and level-filled with the surface of the flexible uniform thickness font sheet 214 and when the abrasive slurry is non-solidified, partially solidified or fully solidified, the permanent magnet can be removed or the electromagnet can be de-energized and the font sheet 214 can be separated from the raised island disk substrate 224. Each flat surfaced island structures 218 then has a uniform thickness abrasive slurry coating.

In addition, the abrasive slurry 210 can contain at least one filler agent selected from the group consisting of: organic particles, inorganic particles, polymer agglomerates, glass beads, hollow glass beads, and fumed silica or combinations of these filler agents (not shown). Some of the filler agents such as hollow glass beads or spheres can provide increased erodibility of the solidified abrasive slurry 210 that is coated on the independent island structure 218 flat surfaces during abrading action. When the solidified abrasive slurry 210 is abraded, individual abrasive particles or portions of them are exposed for abrading action as the erodibile agents are worn down or worn away by contact with the abraded workpiece (not shown).

The liquid abrasive slurry mixture of abrasive particles and an adhesive binder can also contain thickening agents that include fumed silica, glass beads or inorganic or organic agglomerates which can affect the rheological characteristics of the abrasive slurry coating. Adding select quantities of the fumed silica can make the liquid slurry to have shear-dependent thixotropic characteristics where the liquid slurry does not flow freely unless forces are applied to the slurry. Here the slurry mixture that is contained in the font sheet holes positioned at the sites of the respective island top surfaces forms a uniform thickness of slurry across the full surface of each island. Where a filler such as fumed silica is mixed in the coated slurry mixture, the hole font sheet can be separated from the island tops and each individual island thixotropic slurry coating will retain the respective near-original font hole shapes, cylindrical or other shapes, of the island slurry coating even when the slurry is not partially solidified. Also, use of a thixotropic abrasive slurry prevents leakage of the slurry contained in the font holes to gaps between the font sheet and the island top surfaces. After the font sheet is separated, the thixotropic abrasive slurry can be partially or fully solidified.

Figure 8:
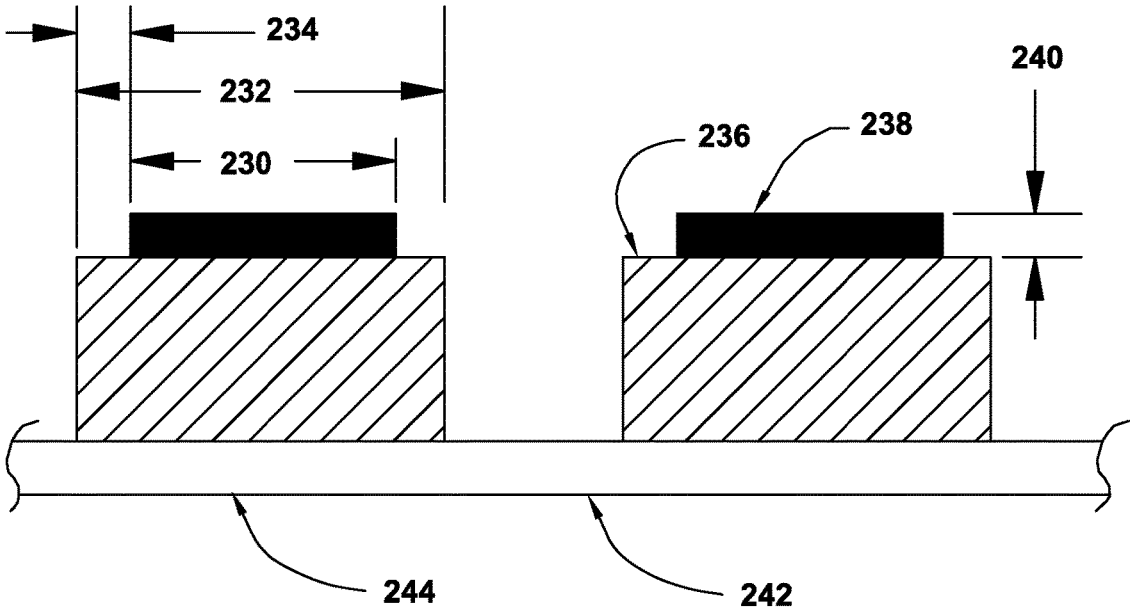
FIG. 8 is a side view of a portion of an abrasive slurry coated raised island disk.

FIG. 8 is a side view of a portion of an abrasive slurry coated raised island disk. The abrasive disk 244 has a flexible backing 242 that has attached raised island structures 236 having flat surfaced island tops that are coated with a mixture of an adhesive and abrasive particles 238. The mixture of an adhesive and abrasive particles 238 has an uniform thickness 240 and has an abrasive mixture coating 238 size 230 that is smaller than the island structures 236 dimensional size 232 by a dimensional size difference 234 that extends around the periphery of the individual raised island structures 236.

Figure 9:
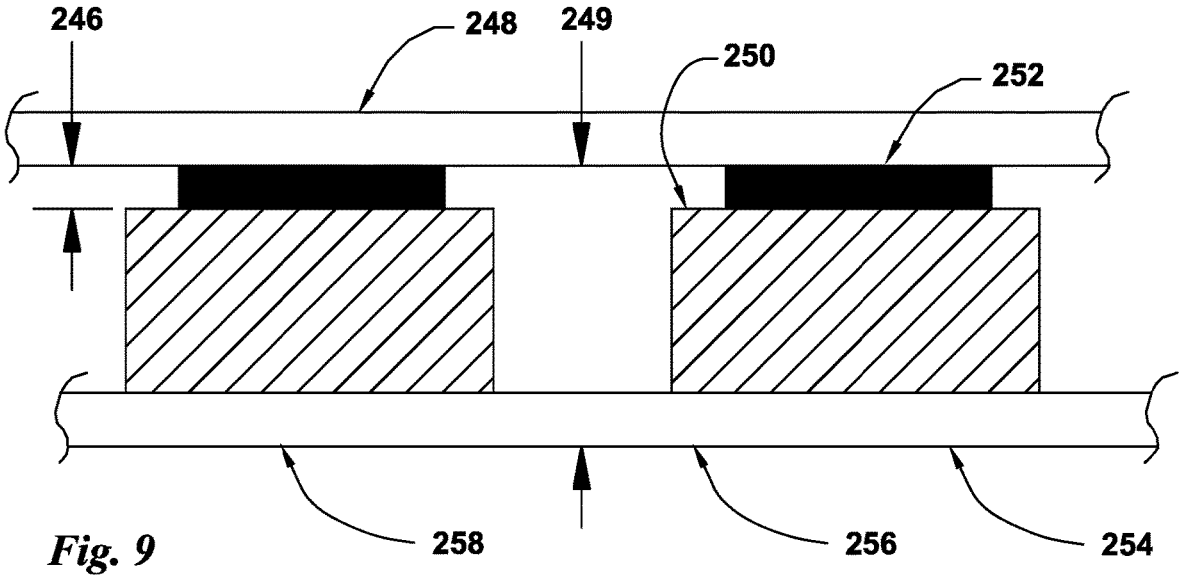
FIG. 9 is a side view of a portion of abrasive slurry coated island flattening plate.

FIG. 9 is a side view of a portion of an abrasive slurry coated raised island disk with a island top surface flattening plate. The abrasive disk 258 has a flexible backing 256 that has attached raised island structures 250 having flat surfaced island tops that are coated with a slurry mixture of adhesive and abrasive particles 252. The mixture of an adhesive and abrasive particles 252 has an uniform thickness 246 and has an abrasive mixture coating that is smaller than the island structures 236 size that extends around the periphery of the individual raised island structures 236. However, when a magnetic steel font sheet (not shown) is separated from the raised island structures 250 when the slurry mixture of adhesive and abrasive particles 252 is not solidified, some portions of the uniform layer of slurry mixture can become distorted and have a non-flat surface (not shown). An island flattening plate 248 is positioned in flat surfaced contact with the non-solidified or partially solidified mixture of an adhesive and abrasive particles 252 to create an uniform thickness 246 of the mixture of the adhesive and abrasive particles 252. Also, the island flattening plate 248 can be positioned a uniform selected distance from the bottom mounting surface 254 of the abrasive disk 258 flexible backing 256 to provide that the abrasive disk 258 has a uniform thickness 249 across the whole abrading surface of the abrasive disk 258.

Figure 10:
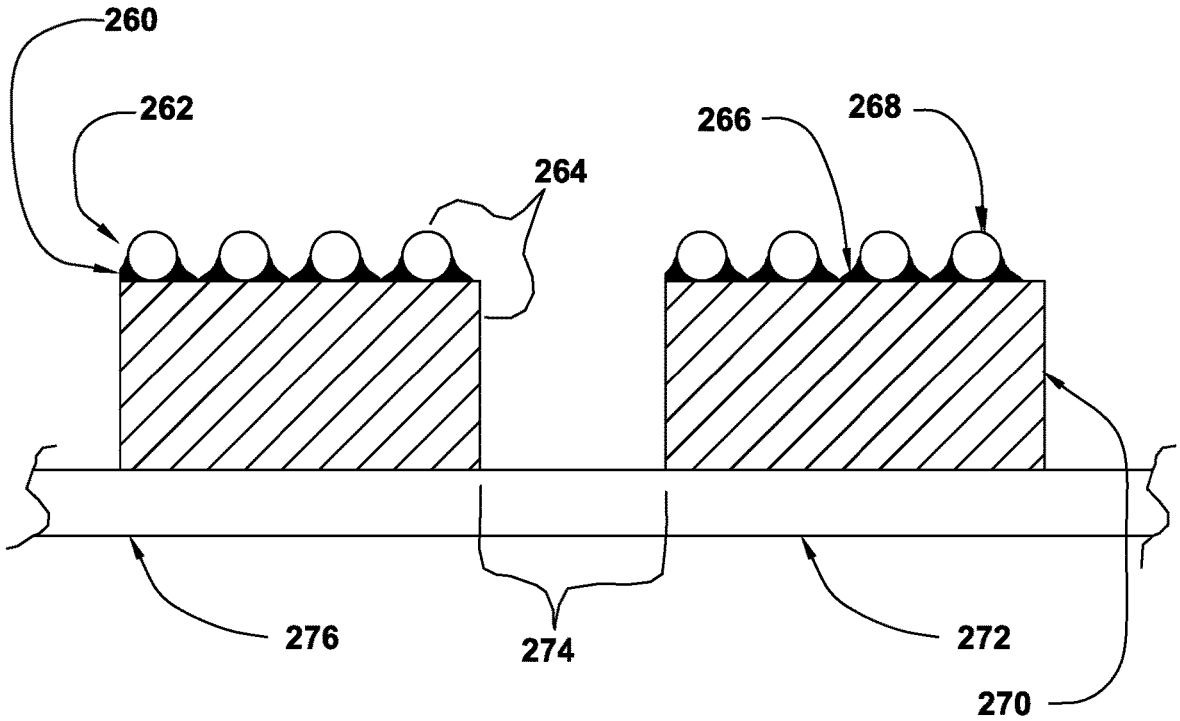
FIG. 10 is a side view of a portion of an abrasive disk with spherical beads.

FIG. 10 is a side view of a portion of an abrasive disk with an integral monolayer of spherical beads. The spherical beads 268 are filled with abrasive particles (not shown) where the beads 268 are attached to the raised islands 270 by a solvent-based resin adhesive binder 266 that shrinks around the base of the beads 268 when the solvent evaporates from the solvent-based resin adhesive binder 266. There are recessed areas 274 that are adjacent to the raised island structures 270. The abrasive coated islands 262 have adhesive resins 266 that have a solvents that can be selected from water, alcohol, methyl ethyl keytone and toluene or combinations them. When the resin 266 is solidified in an oven, the solvents evaporate and the resin 266 volume is reduced leaving portions of the abrasive particle filled beads 268 exposed for abrading.

Figure 11:
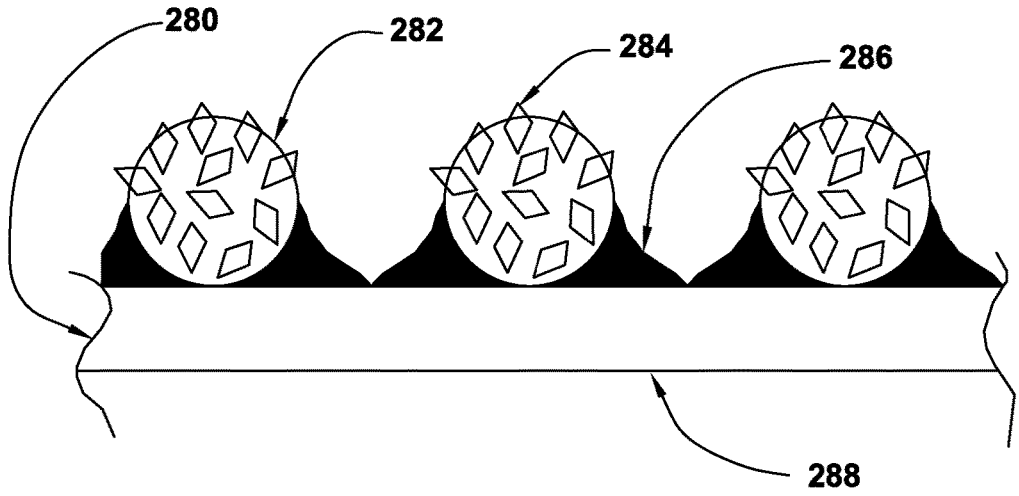
FIG. 11 is a side view of a portion of islands with an integral monolayer of spherical beads.

FIG. 11 is a side view of a portion of an abrasive disk with an integral monolayer of spherical beads. The spherical beads 282 are filled with abrasive particles 284 where the beads 282 are attached to the raised islands 288 by a solvent-based resin adhesive binder 286 that shrinks around the base of the beads 282 when the solvent evaporates from the solvent-based resin adhesive binder 286. When the resin 286 is solidified in an oven, the solvents evaporate and the resin 286 volume is reduced leaving portions of the abrasive particle filled beads 282 exposed for abrading.

The abrasive font sheet coated raised island disk apparatus and processes to use it are described here. An abrasive raised island disk article comprising:

a) a circular, flexible, non-magnetic backing disk substrate having a backing disk substrate thickness, a backing disk substrate outer diameter, a backing disk substrate first surface, and a backing disk substrate second surface;

b) a nominally-annular pattern of individual raised island structures that are integral to or attached to the backing disk substrate first surface wherein the nominally-annular pattern of raised island structures has an approximate outer diameter and an approximate inner diameter wherein each individual raised island structure has a raised island structure flat surfaced top, a raised island structure flat surfaced top shape, a raised island structure flat surfaced top outer periphery, a raised island structure height, and controlled-size recessed gaps exist between adjacent individual raised island structures;

c) a flexible magnetic material abrasive slurry coating font sheet having a coating font sheet first surface, a coating font sheet second surface, a coating font sheet uniform thickness, a coating font sheet nominally-annular pattern of individual open holes wherein the open holes extend through the thickness of the coating font sheet and wherein each individual coating font sheet hole has a coating font sheet hole shape and a coating font sheet hole shape outer periphery and controlled-size portions of the magnetic font sheet material exist between adjacent individual raised island structures and wherein each individual coating font sheet hole shape is smaller than matching respective individual raised island structure flat surfaced top shapes;

d) wherein the coating font sheet second surface can be placed in flat-surfaced contact with the raised island structures flat surfaced tops wherein the individual coating font sheet hole shapes are near-congruent with the matching respective slightly larger individual raised island structure shapes and wherein the coating font sheet hole shape outer peripheries are positioned a selected distance from the raised island structure flat surfaced top outer peripheries and wherein the controlled-size portions of the magnetic font sheet material that exists between adjacent individual open holes are nominally aligned with the controlled-size recessed gaps that exist between the adjacent matching respective individual raised island structures;

e) a magnet can be placed in contact with the backing disk substrate second surface or positioned a selected distance from the backing disk substrate second surface wherein the magnetic force of the magnet acts upon the magnetic abrasive slurry coating font sheet and urges the magnetic coating font sheet second surface to be in conformal flat-surfaced contact with the raised island structures flat surfaced tops wherein the magnetic font sheet having hole openings that are slightly smaller than the raised island structures flat surfaced tops is structurally supported by the slightly larger raised island structure flat surfaced tops when the magnetic font sheet is subjected by magnetic forces that urge the magnetic font sheet toward the raised island structure flat surfaced tops;

f) a liquid slurry mixture of an adhesive and abrasive particles can be introduced into and completely fill each of the coating font sheet individual open holes wherein the liquid slurry mixture of an adhesive and abrasive particles contacts and becomes attached to each individual raised island structure nominally flat surfaced top surface;

g) a squeegee or flexible doctor blade device wherein the squeegee or doctor blade device can be positioned in contact with the magnetic abrasive slurry coating font sheet first surface and moved across all of the individual abrasive slurry filled holes while in conformal contact with the coating font sheet first surface wherein excess abrasive slurry is removed by the squeegee or doctor blade device from each coating font sheet hole and wherein each of the individual abrasive slurry filled coating font sheet holes is level-filled with the coating font sheet first surface;

h) the liquid slurry mixture of adhesive and abrasive particles contained in all of the individual abrasive slurry filled holes can be partially or completely solidified or non-solidified wherein the coating font sheet can be separated from the nominally-annular pattern of raised island structures flat surfaced tops wherein each of the individual raised island structures nominally flat surfaced top surfaces are coated with a uniform thickness of the slurry mixture of adhesive and abrasive particles;

i) the partially or completely solidified or non-solidified mixtures of adhesive and abrasive particles attached to the individual raised island nominally flat surfaced top surfaced individual raised island structures have a first surface that is adhesively attached to the individual raised island structures flat surfaced tops and have partially or completely solidified or non-solidified mixtures of adhesive and abrasive particles exposed second surfaces that opposes the first surfaces.

Also, the magnet is at least one permanent magnet or at least one electromagnet and the flexible non-magnetic disk backing disk material comprises flexible materials selected from the group consisting of: a polymer, aluminum, brass or non-magnetic stainless steel, cloth and woven fiber material or combinations thereof. Further, the abrasive particles comprises particles selected from the group consisting of: diamond, cubic boron nitride and aluminum oxide or combinations thereof. Also, the abrasive slurry adhesive comprises adhesives selected from the group consisting of: phenol formaldehydes, epoxies and polyurethanes or combinations thereof.

In addition, the abrasive slurry adhesive contains solvents comprising solvents selected from the group consisting of: water, alcohol, methyl ethyl keytone and toluene or combinations thereof. And, a release agent coating can be applied to the coating font sheet wherein the release agent comprises release agents selected from the group consisting of: silicone oil, silicon grease, polytetrafluoroethylene coatings, petroleum jelly, paraffin and mold release agents or combinations thereof. Also, the abrasive slurry can contain at least one filler agent selected from the group consisting of: organic particles, inorganic particles, polymer agglomerates, glass beads, hollow glass beads, and fumed silica or combinations thereof.

Furthermore, the individual raised island structure shapes comprises island shapes selected from the group consisting of: circular, elliptical, rhombus, pie and rectangular shapes or combinations thereof and wherein the individual raised island structure shapes are nominally equal in size or the shapes are nominally unequal in size.

Also, a flat plate can be placed in flat-surfaced conformal contact with the second surfaces of the partially or non-solidified slurry mixture of adhesive and abrasive particles coated on the raised island structures after the coating font sheet is separated from the raised island structures flat surfaced tops wherein contact of all of the second surfaces of the slurry mixture of partially or non-solidified slurry mixture adhesive and abrasive slurry coatings on the individual raised island structures with the flat plate positions all of the adhesive and abrasive slurry coatings into a common plane.

And, the flat plate that contacts the second surfaces of the adhesive and abrasive slurry coatings can be positioned parallel to the backing disk substrate second surface wherein the second surfaces of the slurry mixture of adhesive and abrasive slurry coatings on the individual raised island structures are parallel to the backing disk substrate second surface to provide an abrasive raised island disk article having a uniform thickness measured from the second surface of the adhesive and abrasive particles coated raised island structures to the backing disk substrate second surface.

Further, the solidified mixtures of an adhesive and abrasive particles that are adhesively attached to the individual raised island structures nominally flat surfaced top surfaces can be ground flat to provide an abrasive raised island disk article having a uniform thickness measured from the adhesive and abrasive particles coated raised island structures to the backing disk substrate second surface.

In addition, the raised island structures nominally flat surfaced top surfaces can be ground flat prior to coating the raised island structures nominally flat surfaced top surfaces with the liquid slurry mixture of an adhesive and abrasive particles to provide an abrasive raised island disk article having a uniform thickness measured from the adhesive and abrasive particles coated raised island structures to the backing disk substrate second surface.

Also, a process is described for coating a pattern of flat surfaced raised island structures attached to a flexible backing sheet disk substrate with a liquid slurry mixture of an adhesive and abrasive particles comprising:

a) providing a circular, flexible, non-magnetic backing disk substrate having a backing disk substrate thickness, a backing disk substrate outer diameter, a backing disk substrate first surface, and a backing disk substrate second surface;

b) providing a nominally-annular pattern of individual raised island structures that are integral to or attached to the backing disk substrate first surface wherein the nominally-annular pattern of raised island structures has an approximate outer diameter and an approximate inner diameter wherein each individual raised island structure has a raised island structure flat surfaced top, a raised island structure flat surfaced top shape, a raised island structure flat surfaced top outer periphery, a raised island structure height, and controlled-size recessed gaps exist between adjacent individual raised island structures;

c) providing a flexible magnetic material abrasive slurry coating font sheet having a coating font sheet first surface, a coating font sheet second surface, a coating font sheet uniform thickness, a coating font sheet nominally-annular pattern of individual open holes wherein the open holes extend through the thickness of the coating font sheet and wherein each individual coating font sheet hole has a coating font sheet hole shape and a coating font sheet hole shape outer periphery and controlled-size portions of the magnetic font sheet material exist between adjacent individual raised island structures and wherein each individual coating font sheet hole shape is smaller than matching respective individual raised island structure flat surfaced top shapes;

d) placing the coating font sheet second surface in flat-surfaced contact with the raised island structures flat surfaced tops wherein the individual coating font sheet hole shapes are near-congruent with the matching respective slightly larger individual raised island structure shapes and wherein the coating font sheet hole shape outer peripheries are positioned a selected distance from the raised island structure flat surfaced top outer peripheries and wherein the controlled-size portions of the magnetic font sheet material that exists between adjacent individual open holes are nominally aligned with the controlled-size recessed gaps that exist between the adjacent matching respective individual raised island structures;

e) placing a magnet in contact with the backing disk substrate second surface or positioned a selected distance from the backing disk substrate second surface wherein the magnetic force of the magnet acts upon the magnetic abrasive slurry coating font sheet and urges the magnetic coating font sheet second surface to be in conformal flat-surfaced contact with the raised island structures flat surfaced tops wherein the magnetic font sheet having hole openings that are slightly smaller than the raised island structures flat surfaced tops is structurally supported by the slightly larger raised island structure flat surfaced tops when the magnetic font sheet is subjected by magnetic forces that urge the magnetic font sheet toward the raised island structure flat surfaced tops;

f) providing a liquid slurry mixture of an adhesive and abrasive particles that is introduced into and completely fills each of the coating font sheet individual open holes wherein the liquid slurry mixture of an adhesive and abrasive particles contacts and becomes attached to each individual raised island structure nominally flat surfaced top surface;

g) providing a squeegee or flexible doctor blade device wherein the squeegee or doctor blade device that is positioned in contact with the magnetic abrasive slurry coating font sheet first surface and is moved across all of the individual abrasive slurry filled holes while in conformal contact with the coating font sheet first surface wherein excess abrasive slurry is removed by the squeegee or doctor blade device from each coating font sheet hole and wherein each of the individual abrasive slurry filled coating font sheet holes is level-filled with the coating font sheet first surface;

h) partially or completely solidifying or non-solidifying the liquid slurry mixture of adhesive and abrasive particles contained in all of the individual abrasive slurry filled holes wherein the coating font sheet is separated from the nominally-annular pattern of raised island structures flat surfaced tops wherein each of the individual raised island structures nominally flat surfaced top surfaces are coated with a uniform thickness of the slurry mixture of adhesive and abrasive particles;

i) wherein the partially or completely solidified or non-solidified mixtures of adhesive and abrasive particles attached to the individual raised island nominally flat surfaced top surfaced individual raised island structures have a first surface that is adhesively attached to the individual raised island structures flat surfaced tops and have partially or completely solidified or non-solidified mixtures of adhesive and abrasive particles exposed second surfaces that opposes the first surfaces.

Also, a process is described wherein the magnet is at least one permanent magnet or at least one electromagnet and wherein the flexible non-magnetic disk backing disk material comprises flexible materials selected from the group consisting of: a polymer, aluminum, brass or non-magnetic stainless steel, cloth and woven fiber material or combinations thereof.

In addition, a process is described wherein the abrasive particles comprises particles selected from the group consisting of: diamond, cubic boron nitride and aluminum oxide or combinations thereof. And, the abrasive slurry adhesive comprises adhesives selected from the group consisting of: phenol formaldehydes, epoxies and polyurethanes or combinations thereof.

Furthermore, a process is described wherein the abrasive slurry adhesive contains solvents comprising solvents selected from the group consisting of: water, alcohol, methyl ethyl keytone and toluene or combinations thereof. And, a release agent coating is applied to the coating font sheet wherein the release agent comprises release agents selected from the group consisting of: silicone oil, silicon grease, polytetrafluoroethylene coatings, petroleum jelly, paraffin and mold release agents or combinations thereof.

Further, a process is described wherein a flat plate is placed in flat-surfaced conformal contact with the second surfaces of the partially or non-solidified slurry mixture of adhesive and abrasive particles coated on the raised island structures after the coating font sheet is separated from the raised island structures flat surfaced tops wherein contact of all of the second surfaces of the slurry mixture of partially or non-solidified slurry mixture adhesive and abrasive slurry coatings on the individual raised island structures with the flat plate positions all of the adhesive and abrasive slurry coatings into a common plane and wherein the flat plate that contacts the second surfaces of the adhesive and abrasive slurry coatings is positioned parallel to the backing disk substrate second surface to provide an abrasive raised island disk article having a uniform thickness measured from the second surface of the adhesive and abrasive particles coated raised island structures to the backing disk substrate second surface.

An alternative description of the present invention is as an abrasive raised island disk article having:

a) a circular, flexible, non-magnetic backing disk substrate having a backing disk substrate material, a backing disk substrate thickness, a backing disk substrate outer diameter, a backing disk substrate first surface, and a backing disk substrate second surface;

b) a nominally-annular pattern of individual raised island structures integral to or attached to the backing disk substrate first surface wherein the nominally-annular pattern of raised island structures has an approximate outer diameter and an approximate inner diameter and the individual raised island structures have a raised island structure nominally flat surfaced top surface, a raised island structure nominally flat surfaced top shape, a raised island structure nominally flat surfaced top shape centroid, and a raised island structure height;

c) a flexible magnetic material abrasive slurry coating font sheet having a magnetic coating font sheet first surface, a magnetic coating font sheet second surface, a magnetic coating font sheet uniform thickness, and a magnetic coating font sheet nominally-annular pattern of individual open holes wherein the individual open holes extend through the thickness of the magnetic coating font sheet and wherein the individual open holes have a magnetic coating font sheet open hole shape, a magnetic coating font sheet second surface open hole shape, and a magnetic coating font sheet second surface open hole shape centroid;

d) wherein the pattern of the magnetic coating font sheet individual open holes is approximately the same as the pattern of raised island structures whereby placement of the magnetic coating font sheet second surface in flat-surfaced contact with the raised island structures nominally flat surfaced tops allows individual magnetic coating font sheet open holes to be aligned with respective raised island structures nominally flat surfaced tops where the magnetic coating font sheet second surface open hole shape centroids are in near-coincident alignment with the respective individual raised island structure nominally flat surfaced top shapes centroids and where the magnetic coating font sheet individual open holes are nominally-smaller than the respective raised island structures nominally flat surfaced tops;

e) wherein a magnet placed in contact with the backing disk substrate second surface or positioned a selected distance from the backing disk substrate second surface provides a magnetic force that acts upon the magnetic abrasive slurry magnetic coating font sheet thereby urging the magnetic coating font sheet second surface to be in conformal flat-surfaced contact with the raised island structures nominally flat surfaced tops wherein the magnetic font sheet is structurally supported by the raised island structure nominally flat surfaced tops;

f) a thickenable liquid slurry mixture of an adhesive and abrasive particles filling the magnetic coating font sheet individual open holes wherein the liquid slurry mixture of an adhesive and abrasive particles contacts and attaches to individual raised island structure nominally flat surfaced top surfaces;

g) wherein the liquid slurry mixture filled magnetic coating font sheet open holes are level-filled with the magnetic coating font sheet first surface;

h) the liquid slurry mixture of adhesive and abrasive particles contained in the liquid slurry mixture filled individual open holes wherein the magnetic coating font sheet is separated from the nominally-annular pattern of raised island structures nominally flat surfaced top surfaces leaving the individual raised island structures nominally flat surfaced top surfaces coated with a uniform thickness of the liquid slurry mixture of adhesive and abrasive particles; and i) the thickenable mixtures of adhesive and abrasive particles contained in the magnetic coating font sheet open holes, when thickened and attached to the individual raised island structure's individual raised island nominally flat surfaced top surface have a thickenable mixture of adhesive and abrasive particles first surface adhesively attached to the individual raised island structures nominally flat surfaced tops and have partially or completely solidified or non-solidified thickenable mixtures of adhesive and abrasive particles exposed second surfaces that opposes the thickenable mixture of adhesive and abrasive particles first surface.

In addition, a process is described wherein the solidified mixture of an adhesive and abrasive particles that are adhesively attached to the individual raised island structures nominally flat surfaced top surfaces are ground flat to provide an abrasive raised island disk article having a uniform thickness measured from the adhesive and abrasive particles coated raised island structures to the backing disk substrate second surface.

What is claimed:

1. An abrasive raised island disk article comprising:

a) a circular, flexible, non-magnetic backing disk substrate having a backing disk substrate material, a backing disk substrate thickness, a backing disk substrate outer diameter, a backing disk substrate first surface, and a backing disk substrate second surface;

b) a nominally-annular pattern of individual raised island structures integral to or attached to the backing disk substrate first surface wherein the nominally-annular pattern of raised island structures has an approximate outer diameter and an approximate inner diameter and the individual raised island structures have a raised island structure nominally flat surfaced top surface, a raised island structure nominally flat surfaced top shape, a raised island structure nominally flat surfaced top shape centroid, and a raised island structure height;

c) a flexible magnetic material abrasive slurry coating font sheet comprising a magnetic coating font sheet first surface, a magnetic coating font sheet second surface, a magnetic coating font sheet uniform thickness, and a magnetic coating font sheet nominally-annular pattern of individual open holes wherein the individual open holes extend through the thickness of the magnetic coating font sheet and wherein the individual open holes have a magnetic coating font sheet open hole shape, a magnetic coating font sheet second surface open hole shape, and a magnetic coating font sheet second surface open hole shape centroid;

d) wherein the pattern of the magnetic coating font sheet individual open holes is approximately the same as the pattern of raised island structures whereby placement of the magnetic coating font sheet second surface in flat-surfaced contact with the raised island structures nominally flat surfaced tops allows individual magnetic coating font sheet open holes to be aligned with respective raised island structures nominally flat surfaced tops where the magnetic coating font sheet second surface open hole shape centroids are in near-coincident alignment with the respective individual raised island structure nominally flat surfaced top shapes centroids and where the magnetic coating font sheet individual open holes are nominally-smaller than the respective raised island structures nominally flat surfaced tops;

e) wherein a magnet placed in contact with the backing disk substrate second surface or positioned a selected distance from the backing disk substrate second surface provides a magnetic force that acts upon the magnetic abrasive slurry magnetic coating font sheet thereby urging the magnetic coating font sheet second surface to be in conformal flat-surfaced contact with the raised island structures nominally flat surfaced tops wherein the magnetic font sheet is structurally supported by the raised island structure nominally flat surfaced tops;

f) a thickenable liquid slurry mixture of an adhesive and abrasive particles filling the magnetic coating font sheet individual open holes wherein the liquid slurry mixture of an adhesive and abrasive particles contacts and attaches to individual raised island structure nominally flat surfaced top surfaces;

g) wherein the liquid slurry mixture filled magnetic coating font sheet open holes are level-filled with the magnetic coating font sheet first surface;

h) the liquid slurry mixture of adhesive and abrasive particles contained in the liquid slurry mixture filled individual open holes wherein the magnetic coating font sheet is separated from the nominally-annular pattern of raised island structures nominally flat surfaced top surfaces leaving the individual raised island structures nominally flat surfaced top surfaces coated with a uniform thickness of the liquid slurry mixture of adhesive and abrasive particles; and i) the thickenable mixtures of adhesive and abrasive particles contained in the magnetic coating font sheet open holes, when thickened and attached to the individual raised island structure's individual raised island nominally flat surfaced top surface have a thickenable mixture of adhesive and abrasive particles first surface adhesively attached to the individual raised island structures nominally flat surfaced tops and have partially or completely solidified or non-solidified thickenable mixtures of adhesive and abrasive particles exposed second surfaces that opposes the thickenable mixture of adhesive and abrasive particles first surface.

2. The article of claim 1 wherein the magnet comprises a permanent magnet or an electromagnet.

3. The article of claim 1 wherein the flexible non-magnetic backing disk substrate backing disk substrate material comprises flexible materials selected from the group consisting of a polymer, aluminum, brass, non-magnetic stainless steel, cloth, woven fiber material and combinations thereof.

4. The article of claim 1 wherein the abrasive particles comprises particles selected from the group consisting of diamond, cubic boron nitride, aluminum oxide and combinations thereof.

5. The article of claim 1 wherein the liquid slurry mixture adhesive comprises adhesives selected from the group consisting of phenol formaldehydes, epoxies, polyurethanes and combinations thereof.

6. The article of claim 1 wherein the liquid slurry mixture adhesive contains solvents comprising solvents selected from the group consisting of water, alcohols, methyl ethyl ketone, toluene and combinations thereof.

7. The article of claim 1 wherein the liquid slurry mixture contains at least one filler agent selected from the group consisting of organic particles, inorganic particles, polymer agglomerates, glass beads, hollow glass beads, fumed silica and combinations thereof.

8. The article of claim 1 wherein a release agent coating is applied to the magnetic coating font sheet wherein the release agent comprises release agents selected from the group consisting of silicone oil, silicon grease, polytetrafluoroethylene coatings, petroleum jelly, paraffin, mold release agents and combinations thereof.

9. The article of claim 1 wherein the individual raised island structure nominally flat surfaced top shapes comprises island shapes selected from the group consisting of: circular, elliptical, rhombus, pie and rectangular shapes.

10. The article of claim 1 wherein a flat plate is placed in flat-surfaced conformal contact with the exposed second surfaces of the partially or non-solidified liquid slurry mixture of adhesive and abrasive particles coated on the raised island structures after the magnetic coating font sheet is separated from the raised island structures nominally flat surfaced tops wherein contact of the exposed second surfaces of the liquid slurry mixture of partially or non-solidified liquid slurry mixture adhesive and liquid slurry mixture coatings with the flat plate positions the exposed second surfaces of the liquid slurry mixture of partially or non-solidified liquid slurry mixture adhesive and liquid slurry mixture coatings into a common plane.

11. The article of claim 10 wherein the flat plate that contacts the second surfaces of the adhesive and liquid slurry mixture coatings is positioned parallel to the backing disk substrate second surface wherein the second surfaces of the liquid slurry mixture of adhesive and liquid slurry mixture coatings on the individual raised island structures are parallel to the backing disk substrate second surface to provide an abrasive raised island disk article having a uniform thickness measured from the second surface of the adhesive and abrasive particles coated on the raised island structures to the backing disk substrate second surface.

12. The article of claim 1 wherein the second surfaces of the solidified mixtures of adhesive and abrasive particles that are adhesively attached to the individual raised island structures nominally flat surfaced top surfaces are ground flat to provide an abrasive raised island disk article having a uniform thickness measured from the second surfaces of the adhesive and abrasive particles on the coated raised island structures nominally flat surfaced top surfaces to the backing disk substrate second surface.

13. The article of claim 1 wherein the raised island structures nominally flat surfaced top surfaces are ground flat prior to coating the raised island structures nominally flat surfaced top surfaces with the liquid slurry mixture of an adhesive and abrasive particles.

14. A process for coating a pattern of nominally flat surfaced raised island structures attached to a flexible backing sheet disk substrate with a liquid slurry mixture of an adhesive and abrasive particles comprising:

a) providing a circular, flexible, non-magnetic backing disk substrate having a backing disk substrate material, a backing disk substrate thickness, a backing disk substrate outer diameter, a backing disk substrate first surface, and a backing disk substrate second surface;

b) providing a nominally-annular pattern of individual raised island structures integral to or attached to the backing disk substrate first surface wherein the nominally-annular pattern of raised island structures has an approximate outer diameter and an approximate inner diameter and the individual raised island structures have a raised island structure nominally flat surfaced top, a raised island structure nominally flat surfaced top shape, a raised island structure nominally flat surfaced top shape centroid, and a raised island structure height;

c) providing a flexible magnetic material abrasive slurry magnetic coating font sheet comprising a magnetic coating font sheet first surface, a magnetic coating font sheet second surface, a magnetic coating font sheet uniform thickness, and a magnetic coating font sheet nominally-annular pattern of individual open holes wherein the individual open holes extend through the thickness of the magnetic coating font sheet and wherein the individual open holes have a magnetic coating font sheet open hole shape and a magnetic coating font sheet second surface open hole shape centroid;

d) placing the magnetic coating font sheet second surface in flat-surfaced contact with the raised island structures nominally flat surfaced tops and aligning the individual magnetic coating font sheet open holes with respective raised island structures nominally flat surfaced tops where the magnetic coating font sheet second surface open hole shape centroids are in near-coincident alignment with the respective individual raised island structure nominally flat surfaced top shapes centroids and where the magnetic coating font sheet individual open holes are nominally-smaller than the respective raised island structures nominally flat surfaced tops;

e) placing a magnet in contact with the backing disk substrate second surface or positioned a selected distance from the backing disk substrate second surface provides a magnetic force that acts upon the magnetic abrasive slurry magnetic coating font sheet thereby urging the magnetic coating font sheet second surface to be in conformal flat-surfaced contact with the raised island structures nominally flat surfaced tops wherein the magnetic font sheet is structurally supported by the raised island structure nominally flat surfaced tops;

f) providing a thickenable liquid slurry mixture of an adhesive and abrasive particles filling the magnetic coating font sheet individual open holes wherein the liquid slurry mixture of an adhesive and abrasive particles contacts and attaches to individual raised island structures nominally flat surfaced top surfaces;

g) providing a squeegee or flexible doctor blade device wherein the squeegee or doctor blade device that is positioned in contact with the magnetic coating font sheet first surface and is moved across the liquid slurry mixture filled individual open holes while in conformal contact with the magnetic coating font sheet first surface wherein excess liquid slurry mixture is removed by the squeegee or doctor blade device from the magnetic coating font sheet open holes and wherein the abrasive slurry mixture filled magnetic coating font sheet open holes are level-filled with the magnetic coating font sheet first surface;

h) thickening the liquid slurry mixture of adhesive and abrasive particles contained in the individual liquid slurry mixture filled open holes wherein the magnetic coating font sheet is separated from the nominally-annular pattern of raised island structures nominally flat surfaced tops leaving the individual raised island structures nominally flat surfaced top surfaces coated with a uniform thickness of the liquid slurry mixture of adhesive and abrasive particles;

i) wherein the thickened mixture of an adhesive and abrasive particles first surfaces are adhesively attached to the individual raised island nominally flat surfaced top surfaces and have partially or completely solidified or non-solidified thickened mixtures of adhesive and abrasive particles exposed second surfaces that opposes the thickened mixture of adhesive and abrasive particles first surface.

15. A process according to claim 14 wherein the magnet is at least one permanent magnet or at least one electromagnet.

16. A process according to claim 14 wherein the flexible non-magnetic backing disk substrate material comprises flexible materials selected from the group consisting of a polymer, aluminum, brass, non-magnetic stainless steel, cloth and woven inorganic fiber material.

17. A process according to claim 14 wherein the abrasive particles comprises particles selected from the group consisting of diamond, cubic boron nitride and aluminum oxide.

18. A process according to claim 14 wherein the liquid slurry mixture adhesive comprises adhesives selected from the group consisting of phenol formaldehydes, epoxies and polyurethanes.

19. A process according to claim 14 wherein the liquid slurry mixture adhesive contains solvents comprising solvents selected from the group consisting of water, alcohols, methyl ethyl ketone, toluene and combinations thereof.

20. A process according to claim 14 wherein a release agent coating is applied to the magnetic coating font sheet wherein the release agent comprises release agents selected from the group consisting of silicone oil, silicon grease, polytetrafluoroethylene coatings, petroleum jelly, paraffin and mold release agents.

21. A process according to claim 14 wherein a flat plate is placed in flat-surfaced conformal contact with the exposed second surfaces of the partially or non-solidified liquid slurry mixture of adhesive and abrasive particles coated on the raised island structures after the magnetic coating font sheet is separated from the raised island structures nominally flat surfaced tops wherein contact of the exposed second surfaces of the liquid slurry mixture of partially or non-solidified liquid slurry mixture adhesive and liquid slurry mixture coatings on the individual raised island structures with the flat plate positions the exposed second surfaces of the liquid slurry mixture of partially or non-solidified liquid slurry mixture adhesive and liquid slurry mixture coatings into a common plane.

22. A process according to claim 21 wherein the flat plate that contacts the second surfaces of the adhesive and liquid slurry mixture coatings is positioned parallel to the backing disk substrate second surface wherein the second surfaces of the liquid slurry mixture of adhesive and liquid slurry mixture coatings on the individual raised island structures are parallel to the backing disk substrate second surface to provide an abrasive raised island disk article having a uniform thickness measured from the second surface of the adhesive and abrasive particles coated raised island structures to the backing disk substrate second surface.

* * * * *